US012566019B2

(12) United States Patent
Kim et al.

(10) Patent No.: US 12,566,019 B2
(45) Date of Patent: Mar. 3, 2026

(54) ICE MAKER AND REFRIGERATOR HAVING THE SAME

(71) Applicant: LG ELECTRONICS INC., Seoul (KR)

(72) Inventors: Yonghyun Kim, Seoul (KR); Jinil Hong, Seoul (KR); Seungjin Choi, Seoul (KR); Seunggeun Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 18/735,651

(22) Filed: Jun. 6, 2024

(65) Prior Publication Data

US 2024/0318885 A1 Sep. 26, 2024

Related U.S. Application Data

(63) Continuation of application No. 17/858,356, filed on Jul. 6, 2022, now Pat. No. 12,025,359, which is a (Continued)

(30) Foreign Application Priority Data

Nov. 16, 2018 (KR) ..... 10-2018-0142123
Jul. 22, 2019 (KR) ..... 10-2019-0088287

(51) Int. Cl.
*F25C 1/24* (2018.01)
*F25C 1/04* (2018.01)
(Continued)

(52) U.S. Cl.
CPC ..... *F25C 1/24* (2013.01); *F25C 1/04* (2013.01); *F25C 1/25* (2018.01); *F25C 5/08* (2013.01);
(Continued)

(58) Field of Classification Search
CPC ..... F25D 2700/122; F25D 11/02; H01L 2224/16225; H01L 24/97;
(Continued)

(56) References Cited

U.S. PATENT DOCUMENTS 4,417,716 A 11/1983 Penna et al.
4,903,506 A 2/1990 Delisle et al.
(Continued)

FOREIGN PATENT DOCUMENTS

CN H02-176380 7/1990
CN 1455856 11/2003
(Continued)

OTHER PUBLICATIONS

Extended European Search Report in European Appln. No. 19209304.5, dated Apr. 3, 2020, 9 pages.
(Continued)

*Primary Examiner* — Filip Zec
(74) *Attorney, Agent, or Firm* — Fish & Richardson P.C.

(57) ABSTRACT

The present disclosure relates to an ice maker and a refrigerator having the ice maker. An ice maker according to the present disclosure includes: an upper assembly including an upper tray forming an upper chamber, which is a portion an ice chamber, and having an upper opening, and a temperature sensor configured to sense temperature of the ice chamber in contact with the upper tray; and a lower assembly being rotatable with respect to the upper assembly and having a lower tray forming a lower chamber that is another portion of the ice chamber, in which a contact portion between the temperature sensor and the upper tray is positioned closer to a contact surface of the upper tray and the lower tray than the upper opening.

18 Claims, 21 Drawing Sheets

Related U.S. Application Data continuation of application No. 16/685,711, filed on Nov. 15, 2019, now Pat. No. 11,408,660.

(51) Int. Cl.

| | |
|---|---|
| ***F25C 1/25*** | (2018.01) |
| ***F25C 5/08*** | (2006.01) |
| ***F25C 5/20*** | (2018.01) |
| ***F25D 11/02*** | (2006.01) |

(52) U.S. Cl.

CPC ..... *F25C 5/22* (2018.01); *F25D 11/02* (2013.01); *F25C 2700/12* (2013.01); *F25D 2700/122* (2013.01)

(58) Field of Classification Search

CPC ..... H01L 2924/15311; H01L 2924/181; F25C 1/04; F25C 1/24; F25C 1/25; F25C 2700/12; F25C 5/08; F25C 5/22

See application file for complete search history.

(56) References Cited

U.S. PATENT DOCUMENTS

| | | | | |
|---|---|---|---|---|
| 4,909,039 | A | 3/1990 | Yamada et al. | |
| 4,910,974 | A | 3/1990 | Hara et al. | |
| 5,056,322 | A * | 10/1991 | Patrick | F25C 5/04 62/73 |
| 5,182,916 | A | 2/1993 | Oike et al. | |
| 5,769,541 | A | 6/1998 | Lee et al. | |
| 6,526,763 | B2 | 3/2003 | Tchougounov et al. | |
| 6,745,578 | B2 * | 6/2004 | Collins | F25C 5/187 62/344 |
| 7,401,470 | B2 * | 7/2008 | Lee | F25C 5/22 62/347 |
| 7,665,316 | B2 | 2/2010 | Ito et al. | |
| 8,316,661 | B2 | 11/2012 | Choi | |
| 8,499,577 | B2 | 8/2013 | Watson et al. | |
| 8,534,087 | B2 | 9/2013 | Lee et al. | |
| 9,273,892 | B2 * | 3/2016 | Lee | F25C 5/08 |
| 9,335,081 | B2 | 5/2016 | Son et al. | |
| 9,506,680 | B2 | 11/2016 | Jeong et al. | |
| 9,696,079 | B2 * | 7/2017 | Boarman | F25C 1/10 |
| 9,885,510 | B2 | 2/2018 | Son et al. | |
| 10,060,664 | B2 | 8/2018 | Celik et al. | |
| 10,126,037 | B2 * | 11/2018 | Barrena | F25C 5/187 |
| 10,415,866 | B2 | 9/2019 | Brabenec et al. | |
| 10,801,768 | B2 | 10/2020 | Junge et al. | |
| 10,907,873 | B2 * | 2/2021 | Lee | F25C 5/24 |
| 10,969,152 | B2 * | 4/2021 | Yoon | F25C 1/18 |
| 11,435,126 | B2 * | 9/2022 | Larson | F25C 5/08 |
| 11,543,166 | B2 | 1/2023 | Olvera et al. | |
| 11,619,434 | B2 * | 4/2023 | Lee | F25C 5/182 62/344 |
| 2004/0261442 | A1 * | 12/2004 | Chung | F25C 5/24 62/344 |
| 2005/0115266 | A1 * | 6/2005 | Lim | F25C 5/08 62/351 |
| 2006/0086135 | A1 | 4/2006 | Wu et al. | |
| 2010/0018226 | A1 | 1/2010 | Kim et al. | |
| 2010/0122543 | A1 | 5/2010 | Lee et al. | |
| 2010/0147011 | A1 | 6/2010 | Kang et al. | |
| 2010/0205996 | A1 | 8/2010 | Ducharme et al. | |
| 2010/0218542 | A1 | 9/2010 | McCollough et al. | |
| 2010/0319367 | A1 | 12/2010 | Kim et al. | |
| 2011/0146312 | A1 | 6/2011 | Hong et al. | |
| 2012/0023996 | A1 | 2/2012 | Herrera et al. | |
| 2013/0014536 | A1 | 1/2013 | Son et al. | |
| 2013/0081412 | A1 | 4/2013 | Son et al. | |
| 2013/0167563 | A1 | 7/2013 | Lee et al. | |
| 2013/0192279 | A1 | 8/2013 | McCollough et al. | |
| 2013/0327082 | A1 | 12/2013 | Son et al. | |
| 2014/0020422 | A1 | 1/2014 | Yao et al. | |
| 2014/0130537 | A1 | 5/2014 | Gu et al. | |
| 2014/0182325 | A1 * | 7/2014 | Lee | F25C 5/08 62/340 |
| 2017/0211865 | A1 * | 7/2017 | Lee | F25C 5/22 |
| 2017/0321943 | A1 | 11/2017 | Ji et al. | |
| 2017/0370628 | A1 * | 12/2017 | Knatt | F25C 1/25 |
| 2018/0216863 | A1 | 8/2018 | Ji et al. | |
| 2019/0041112 | A1 * | 2/2019 | Chatelle | F25C 5/22 |

FOREIGN PATENT DOCUMENTS

| | | |
|---|---|---|
| CN | 101529173 | 9/2009 |
| CN | 102997587 | 3/2013 |
| CN | 103486810 | 1/2014 |
| CN | 103486811 | 1/2014 |
| CN | 103582790 | 2/2014 |
| CN | 105683688 | 6/2016 |
| CN | 111197906 | 5/2020 |
| CN | 115031484 | 9/2022 |
| CN | 115164501 | 10/2022 |
| EP | 0326144 | 8/1989 |
| JP | H01-230970 A | 9/1989 |
| JP | H 05203299 | 8/1993 |
| JP | H 06323704 | 11/1994 |
| JP | 2003-336947 | 11/2003 |
| JP | 2004-309046 | 11/2004 |
| JP | 2005-257114 | 9/2005 |
| JP | 2012-255579 | 12/2012 |
| JP | 2013032871 | 2/2013 |
| JP | 5767050 | 8/2015 |
| KR | 10-1997-0047506 | 7/1997 |
| KR | 20060007067 | 1/2006 |
| KR | 20060106052 | 10/2006 |
| KR | 10-0833860 | 6/2008 |
| KR | 10-2010-0056293 | 5/2010 |
| KR | 10-2013-0009332 | 1/2012 |
| KR | 10-2013-0036421 | 4/2013 |
| KR | 20140039880 | 4/2014 |
| KR | 20140059938 | 5/2014 |
| KR | 20140088321 | 7/2014 |
| KR | 10-2016-0004880 | 1/2016 |
| KR | 20160127541 | 11/2016 |
| KR | 10-1850918 | 5/2018 |
| WO | WO 2018041524 | 3/2018 |

OTHER PUBLICATIONS

International Search Report and Written Opinion in International Appln. No. PCT/KR2019/015586, dated Feb. 27, 2020, 11 pages.

Notice of Allowance in Chinese Appln. No. 2022107076881, mailed on Nov. 16, 2023, 7 pages (with English translation).

Notice of Allowance in Chinese Appln. No. 202210706229.1, dated Apr. 22, 2023, 8 pages (with English translation).

Notice of Allowance in Chinese Appln. No. 202210707676.9, dated Apr. 23, 2012, 8 pages (with English translation).

Notice of Allowance in Korean Appln. No. 10-2023-0008159, dated Jun. 8, 2023, 17 pages (with English translation).

Office Action in Chinese Appln. No. 201911114764.2, dated Mar. 9, 2021, 19 pages (with English translation).

Office Action in Chinese Appln. No. 202210706213.0, dated Apr. 29, 2023, 18 pages (with English translation).

Office Action in Chinese Appln. No. 202210707688.1, dated Apr. 22, 2023, 18 pages (with English translation).

Office Action in Korean Appln. No. 10-2023-0008158, dated Feb. 15, 2023, 10 pages (with English translation).

Office Action in Korean Appln. No. 10-2023-0008159, dated Feb. 15, 2023, 11 pages (with English translation).

Search Report for Request for Accelerated Examination in Korean Appln. No. 10-2023-0008157, dated Feb. 3, 2023, 13 pages.

Search Report for Request for Accelerated Examination in Korean Appln. No. 10-2023-0008158, dated Feb. 3, 2023, 10 pages.

Search Report for Request for Accelerated Examination in Korean Appln. No. 10-2023-0008159, dated Feb. 3, 2023, 12 pages.

Search Report for Request for Accelerated Examination in Korean Appln. No. 10-2023-0008160, dated Feb. 3, 2023, 8 pages.

(56) References Cited

OTHER PUBLICATIONS

Office Action in Korean Appln. No. 10-2023-0121284, mailed on Dec. 1, 2025, 11 pages (with English translation).

* cited by examiner

ICE MAKER AND REFRIGERATOR HAVING THE SAME

CROSS REFERENCE TO RELATED APPLICATION

The present application is a continuation of U.S. application Ser. No. 17/858,356, filed Jul. 6, 2022 which is a continuation of U.S. application Ser. No. 16/685,711, filed on Nov. 15, 2019 (now U.S. Pat. No. 11,408,660), which claims priority to Korean Patent Application No. 10-2018-0142123, filed on Nov. 16, 2018, and Korean Patent Application No. 10-2019-0088287, filed on Jul. 22, 2019, the entire contents of which are incorporated herein for all purposes by reference.

BACKGROUND OF THE INVENTION

Field of the Invention

The present disclosure relates to an ice maker and a refrigerator having the ice maker.

Description of the Related Art

In general, a refrigerator is a home appliance that can keep food at a low temperature in a storage space that is closed by a door.

The refrigerator can keep stored food cold or frozen by cooling the inside of the storage space using cold air.

In general, an ice maker for making ice is disposed in refrigerators.

The ice maker is configured to make ice by keeping water, which is supplied from a water supply source or a water tank, in a tray.

Further, the ice maker is configured to be able to transfer the made ice from the ice tray in a heating type or a twisting type.

The ice maker that automatically receives water and transfers ice is formed to be open upward, thereby lifting up the formed ice.

The ice that is made by the ice maker having this structure has at least one flat side such as a crescent moon shape or a cubic shape.

Meanwhile, when ice is formed in a spherical shape, it may be more convenient to use the ice and it is possible to provide a different feeling of use to users. Further, when pieces of ice that have been made are stored, the contact areas of the pieces of ice are minimized, so it is possible to minimizing pieces of ice sticking to one another.

An ice maker has been disclosed in Korean Patent No. 10-1850918 that is a prior art document 1.

The ice maker in prior art document includes: an upper tray having arrays of a plurality of upper cells having a semispherical shape, and having a pair of link guides extending upward from both side ends; a lower tray having arrays of a plurality of lower cells having a semispherical shape and rotatably connected to the upper tray; and an ice transfer heater for heating the upper tray.

The ice transfer heater is formed in a U-shape and disposed on the top surface of the upper tray. The ice transfer heater is in contact with the upper tray at a higher position than the upper cell, the time that is needed for the heat from the ice transfer heater to transfer to the surface of the upper cells increases.

Also, since the upper portion of the ice transfer heater is exposed to cold air, there is a defect that the heat from the ice transfer heater is not concentrated on the upper tray.

A refrigerator having an ice maker has been disclosed in Japanese Patent No. 5767050 that is prior art document 2.

The ice maker includes an ice-making dish having a plurality of pockets and being rotatable, an ice-making heater being in contact with the bottom surface of the ice-making dish, and a thermistor sensing whether there is water.

In prior art document 2, the thermistor and the ice-making heater are rotated with the ice-making dish in a state in which the thermistor and the ice-making heater are in contact with the ice-making dish, so wires connected to the thermistor and the ice-making heater may twist.

Also, since the thermistor and the ice-making heater are rotated with the ice-making dish, there is a defect that the structure for fixing the positions of the thermistor and the ice-making heater is complicated.

SUMMARY OF THE INVENTION

An embodiment provides an ice maker in which a temperature sensor senses the temperature of an upper tray of which the position is fixed, so a wire connected to the temperature sensor is prevented from twisting.

An embodiment provides an ice maker in which a temperature sensor is in contact with an upper tray in a state in which the temperature sensor is accommodated in an accommodation groove of the upper tray, so the temperature sensing accuracy is improved.

An embodiment provides an ice maker in which a temperature sensor is easy to mount without interference with a heater that operates for transferring ice.

An embodiment provides an ice maker that prevents deterioration of sensing accuracy of a temperature sensor due to heat from a heater that operates to make transparent ice in an ice-making process.

An embodiment provides a refrigerator including the ice maker described above.

An ice maker according to an aspect may include: an upper tray forming an upper chamber that is a portion an ice chamber; a temperature sensor configured to sense temperature of the upper tray or the ice chamber; and a lower tray forming a lower chamber that is another portion of the ice chamber.

The lower tray may rotate with respect to the upper tray. The lower tray may rotate in a state in which positions of the upper tray and the temperature sensor are fixed.

The temperature sensor may be in contact with the upper tray. The upper tray may include an upper opening. Cold air may be supplied to the ice chamber, water may be supplied to the ice chamber, or cold air and water may be supplied to the ice chamber through the upper opening.

A contact portion between the temperature sensor and the upper tray may be positioned closer to a contact surface of the upper tray and the lower tray than the upper opening.

The upper tray may further include an upper tray body defining the upper chamber.

A recessed sensor accommodation part configured to accommodate the temperature sensor may be provided on the upper tray body. A bottom surface of the temperature sensor may be in contact with a bottom surface of the sensor accommodation part in a state in which the temperature sensor is accommodated in the sensor accommodation part.

The ice maker may further include an upper case supporting the upper tray.

The upper case may include a first installation rib and a second installation rib spaced part from each other to support the temperature sensor. The first and second installation ribs and the temperature sensor may be accommodated in the sensor accommodation part in a state in which the temperature sensor is accommodated in the first installation rib and the second installation rib.

The ice maker may further include an upper heater configured to provide heat to the upper tray.

The upper heater and the temperature sensor may be installed in the upper case.

Installation heights of the upper heater and the temperature sensor in the upper case may be different.

At least a portion of the temperature sensor may vertically overlap the upper heater.

The upper tray may include: a heater accommodation part configured to accommodate the upper heater; and a sensor accommodation part configured to accommodate the temperature sensor.

For example, the sensor accommodation part may be formed by recessing downward from a bottom of the heater accommodation part.

In this embodiment, a distance between a tray contact surface with the lower tray of the upper tray and the temperature sensor may be shorter than a distance between the tray contact surface and the upper heater.

The upper tray may include an upper opening, and a distance between a bottom surface of the temperature sensor and the tray contact surface may be shorter than a distance between the upper opening and the bottom of the temperature sensor.

The ice maker may further include an insulator surrounding at least a portion of the temperature sensor.

An ice maker according to another aspect may include: an upper assembly including an upper tray forming an upper chamber that is a portion an ice chamber and a temperature sensor configured to sense temperature of the ice chamber; and a lower assembly including being rotatable with respect to the upper assembly and including a lower tray forming a lower chamber that is another portion of the ice chamber.

The upper tray may include an upper opening. The temperature sensor may be in contact with the upper tray. A contact portion between the temperature sensor and the upper tray may be positioned closer to a contact surface of the upper tray and the lower tray than the upper opening.

The upper tray may further include an upper tray body defining the upper chamber. A recessed sensor accommodation part configured to accommodate the temperature sensor may be provided on the upper tray body.

A bottom surface of the temperature sensor may be in contact with a bottom surface of the sensor accommodation part in a state in which the temperature sensor is accommodated in the sensor accommodation part.

The upper tray body defines a plurality of upper chambers, and the sensor accommodation part is positioned between two adjacent upper chambers.

The ice maker may further include an upper case supporting the upper tray. A portion of the upper case may be in contact with a top surface of the upper tray.

The temperature sensor may be in contact with the upper tray in a state in which the temperature sensor is installed in the upper case.

The upper case may include a first installation rib and a second installation rib spaced part from each other to support the temperature sensor.

The first and second installation ribs and the temperature sensor may be accommodated in the sensor accommodation part in a state in which the temperature sensor is accommodated in the first installation rib and the second installation rib.

The upper case may further include a pressing rib pressing the temperature sensor between the first installation rib and the second installation rib.

The pressing rib may include a first pressing rib positioned at the first installation rib and a second pressing rib positioned at the second installation rib. Each of the pressing ribs may press a top surface of the temperature sensor.

The first pressing rib or the second pressing rib may include a sleeve providing a passage for a wire connected to the temperature sensor.

The first installation rib or the second installation rib may be inclined upward as going outside.

The ice maker may further include: an upper heater configured to provide heat to the upper tray; and an upper case supporting the upper tray, and the upper heater and the temperature sensor may be installed in the upper case.

The upper tray may include: a heater accommodation part configured to accommodate the upper heater; and a sensor accommodation part configured to accommodate the temperature sensor.

The sensor accommodation part may be formed by recessing downward from a bottom of the heater accommodation part.

The ice maker may further include an upper heater configured to provide heat to the upper tray, and a distance between a tray contact surface with the lower tray of the upper tray and the temperature sensor may be shorter than a distance between the tray contact surface and the upper heater.

The upper tray may include an upper opening, and a distance between a bottom surface of the temperature sensor and the tray contact surface may be shorter than a distance between the upper opening and the bottom of the temperature sensor.

The ice maker may further include a lower heater providing heat to the ice chamber in an ice making process, and being in contact with the lower tray.

The ice maker may further include an insulator surrounding at least a portion of the temperature sensor.

A refrigerator according to another aspect includes: a cabinet having a freezing compartment; and an ice maker making ice using cold air that cools the freezing compartment, in which the ice maker comprises: an upper tray forming an upper chamber that is a portion an ice chamber; an upper heater configured to provide heat to the upper tray; a temperature sensor configured to sense temperature of the upper tray; a lower tray being rotatable with respect to the upper try and forming another portion of the ice chamber; and a lower heater configured to provide heat to the lower tray.

The lower tray and the lower heater are rotated in a state in which positions of the upper tray, the upper heater, and the temperature sensor are fixed in an ice transfer process The temperature sensor may be positioned in an area between the upper heater and the lower heater.

An ice maker according to another aspect includes: an upper assembly that includes an upper tray having an upper tray formed to be recessed upward to define an upper portion of an ice chamber in which water is filled and ice is made, an upper support supporting a first surface of the upper tray in contact with the first surface, and an upper case being in contact with a second surface of the upper tray and coupled to the upper support; a lower assembly that includes a lower tray having a lower chamber formed to be recessed upward to define a lower portion of the ice chamber, and is rotatably connected to the upper assembly; and a temperature sensor that senses temperature of the upper tray in contact with the upper tray.

A recessed sensor accommodation part in which the temperature sensor is accommodated may be formed on the second surface of the upper tray.

Also, a refrigerator according to another aspect of the present disclosure includes a cabinet forming a storage chamber, and an ice maker disposed in the storage chamber and making ice by freezing water supplied to an ice chamber.

An ice maker includes: an upper assembly that includes an upper tray having an upper tray formed to be recessed upward to define an upper portion of an ice chamber in which water is filled and ice is made, an upper support supporting a first surface of the upper tray in contact with the first surface, and an upper case being in contact with a second surface of the upper tray and coupled to the upper support; a lower assembly that includes a lower tray having a lower chamber formed to be recessed upward to define a lower portion of the ice chamber, and is rotatably connected to the upper assembly; and a temperature sensor that senses temperature of the upper tray in contact with the upper tray.

A recessed sensor accommodation part in which the temperature sensor is accommodated may be formed on the second surface of the upper tray.

DETAILED DESCRIPTION OF THE INVENTION

Figure 1:
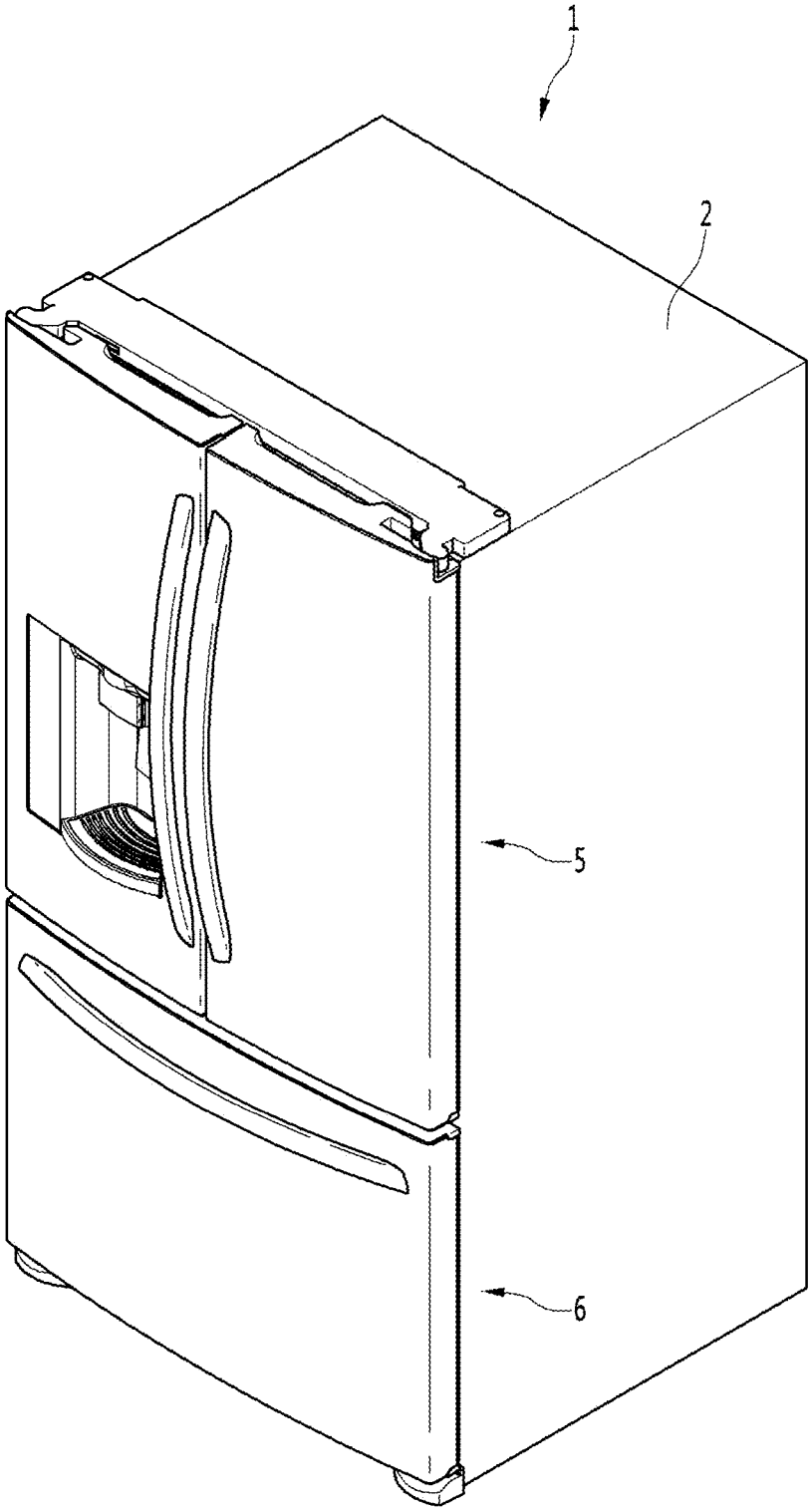
FIG. 1 is a perspective view of a refrigerator according to an embodiment of the present disclosure.

Hereinafter, embodiments of the present disclosure are described in detail with reference to exemplary drawings. It should be noted that when components are given reference numerals in the drawings, the same components are given the same reference numerals even if they are shown in different drawings. Further, in the following description of embodiments of the present disclosure, when detailed description of well-known configurations or functions is determined as interfering with understanding of the embodiments of the present disclosure, they are not described in detail.

Further, terms "first", "second", "A", "B", "(a)", and "(b)" can be used in the following description of the components of embodiments of the present disclosure. The terms are provided only for discriminating components from other components and, the essence, sequence, or order of the components are not limited by the terms. When a component is described as being "connected", "combined", or "coupled" with another component, it should be understood that the component may be connected or coupled to another component directly or with another component interposing therebetween.

Figure 2:
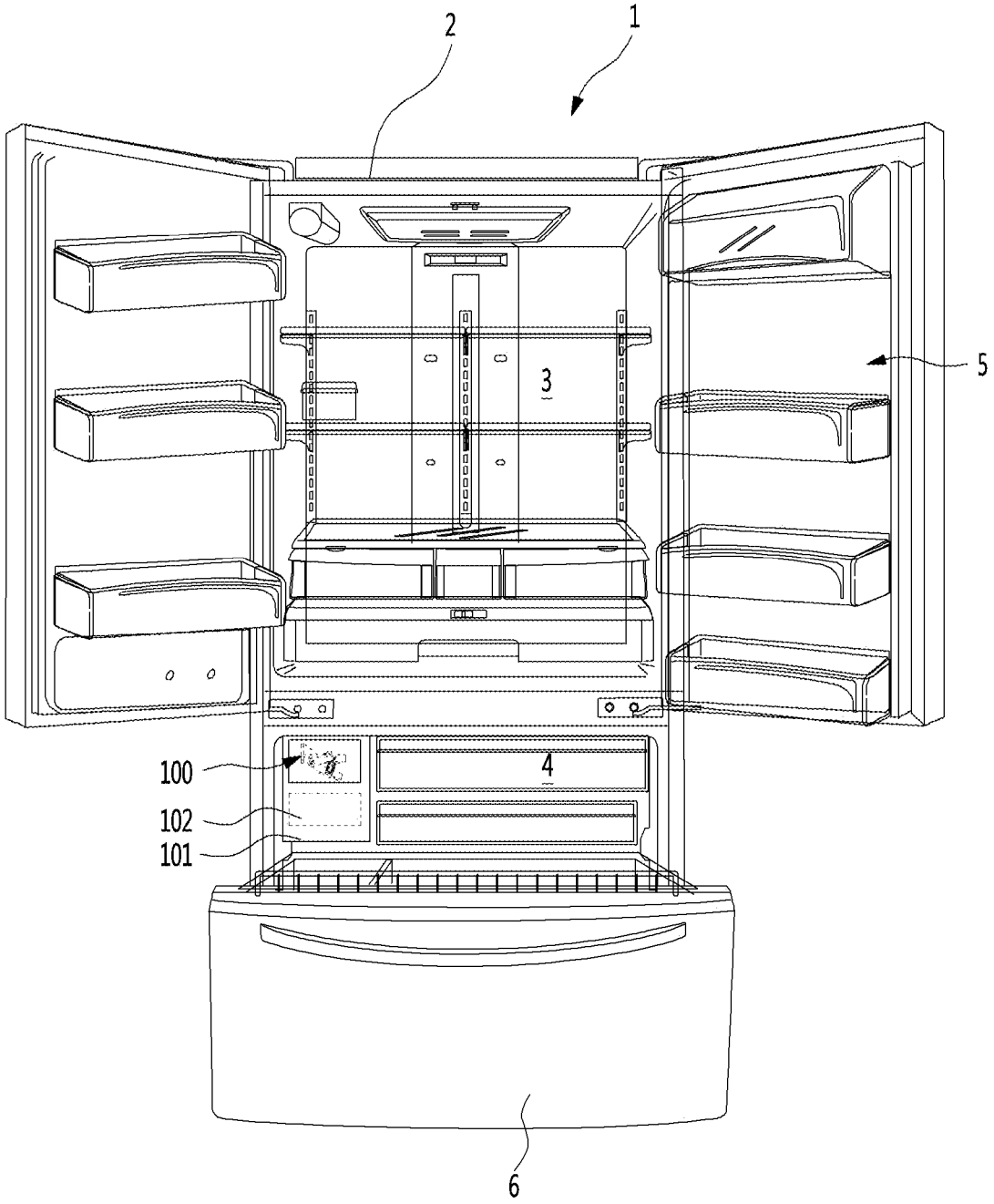
FIG. 2 is a view showing a state in which a door of the refrigerator of FIG. 1 is opened.

FIG. 1 is a perspective view of a refrigerator according to an embodiment, and FIG. 2 is a view illustrating a state in which a door of the refrigerator of FIG. 1 is opened.

Referring to FIGS. 1 and 2, a refrigerator 1 according to an embodiment may include a cabinet 2 defining a storage space and a door that opens and closes the storage space.

In detail, the cabinet 2 may define the storage space that is vertically divided by a barrier. Here, a refrigerating compartment 3 may be defined at an upper side, and a freezing compartment 4 may be defined at a lower side.

Accommodation members such as a drawer, a shelf, a basket, and the like may be provided in the refrigerating compartment 3 and the freezing compartment 4.

The door may include a refrigerating compartment door 5 opening/closing the refrigerating compartment 3 and a freezing compartment door 6 opening/closing the freezing compartment 4.

The refrigerating compartment door 5 may be constituted by a pair of left and right doors and be opened and closed through rotation thereof. The freezing compartment door 6 may be inserted and withdrawn in a drawer manner.

Alternatively, the arrangement of the refrigerating compartment 3 and the freezing compartment 4 and the shape of the door may be changed according to kinds of refrigerators, but are not limited thereto. For example, the embodiments may be applied to various kinds of refrigerators. For example, the freezing compartment 4 and the refrigerating compartment 3 may be disposed at left and right sides, or the freezing compartment 4 may be disposed above the refrigerating compartment 3.

An ice maker 100 may be provided in the freezing compartment 4. The ice maker 100 is constructed to make ice by using supplied water. Here, the ice may have a spherical shape.

An ice bin 102 in which the made ice is stored after being transferred from the ice maker 100 may be further provided below the ice maker 100.

The ice maker 100 and the ice bin 102 may be mounted in the freezing compartment 4 in a state of being respectively mounted in separate housings 101.

A user may open the refrigerating compartment door 6 to approach the ice bin 102, thereby obtaining the ice.

For another example, a dispenser 7 for dispensing purified water or the made ice to the outside may be provided in the refrigerating compartment door 5, The ice made in the ice maker 100 or the ice stored in the ice bin 102 after being made in the ice maker 100 may be transferred to the dispenser 7 by a transfer unit. Thus, the user may obtain the ice from the dispenser 7.

Hereinafter, the ice maker will be described in detail with reference to the accompanying drawings.

Figure 3:
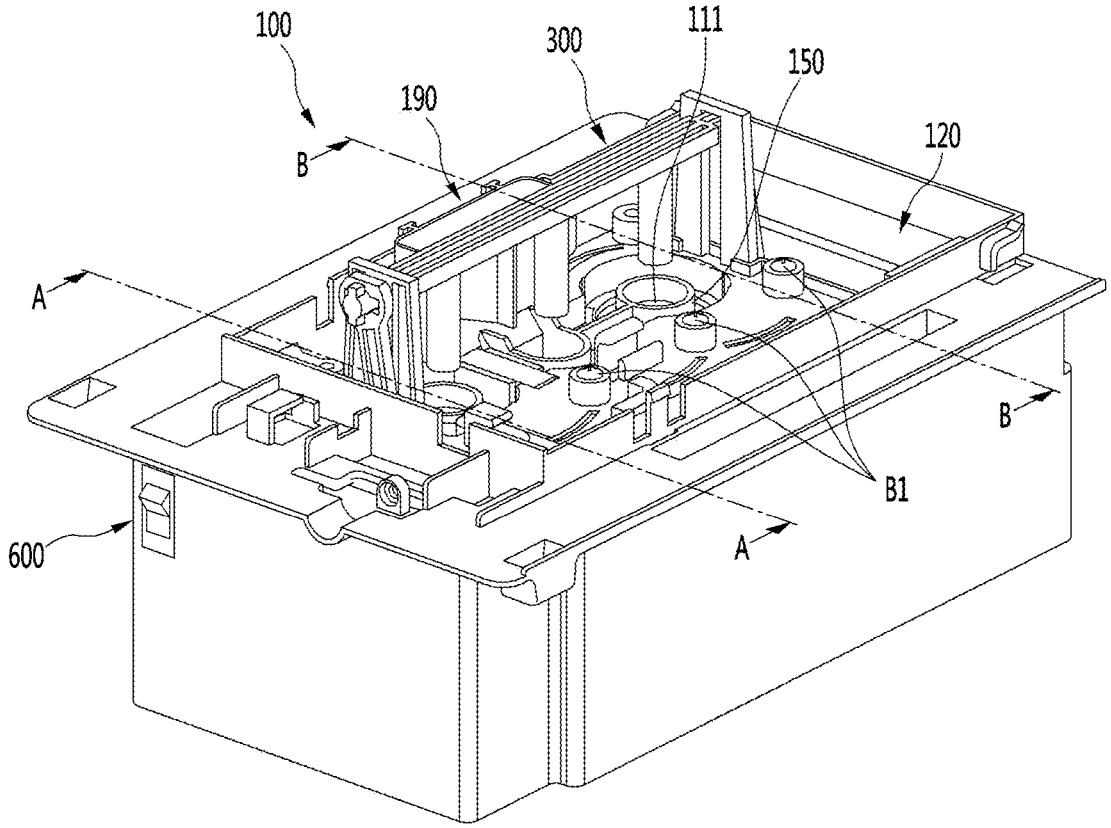
FIGS. 3 and 4 are perspective views of an ice maker according to one embodiment of the present disclosure.
Figure 4:
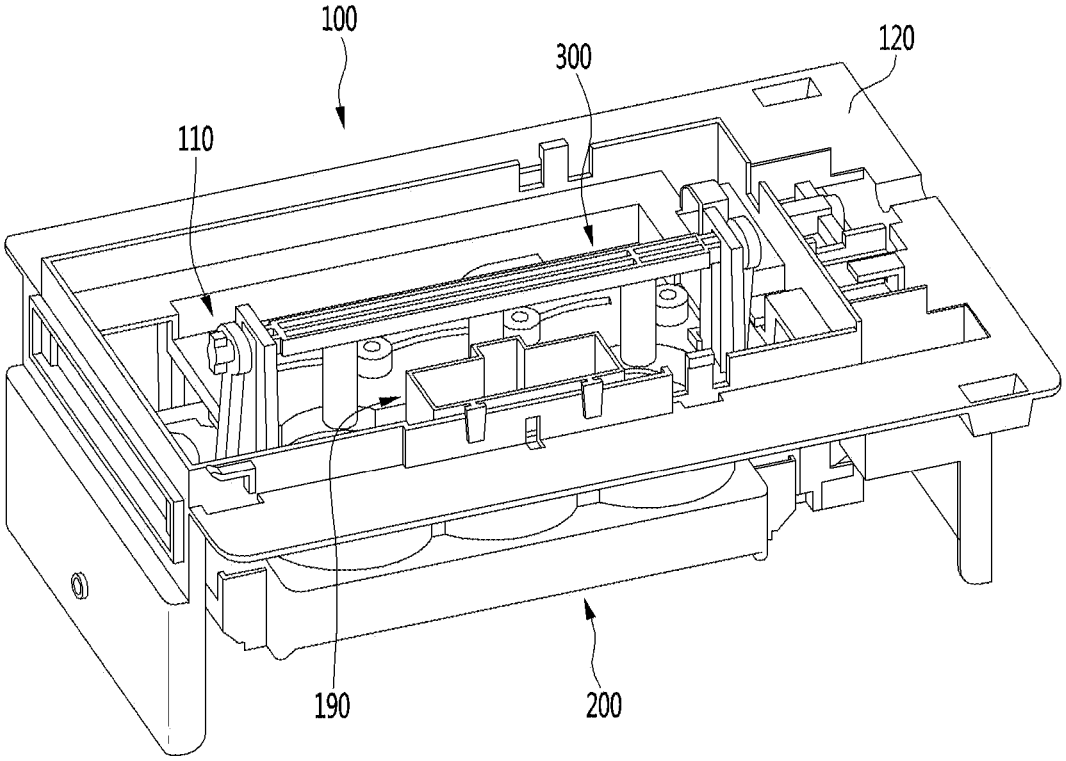
Figure 5:
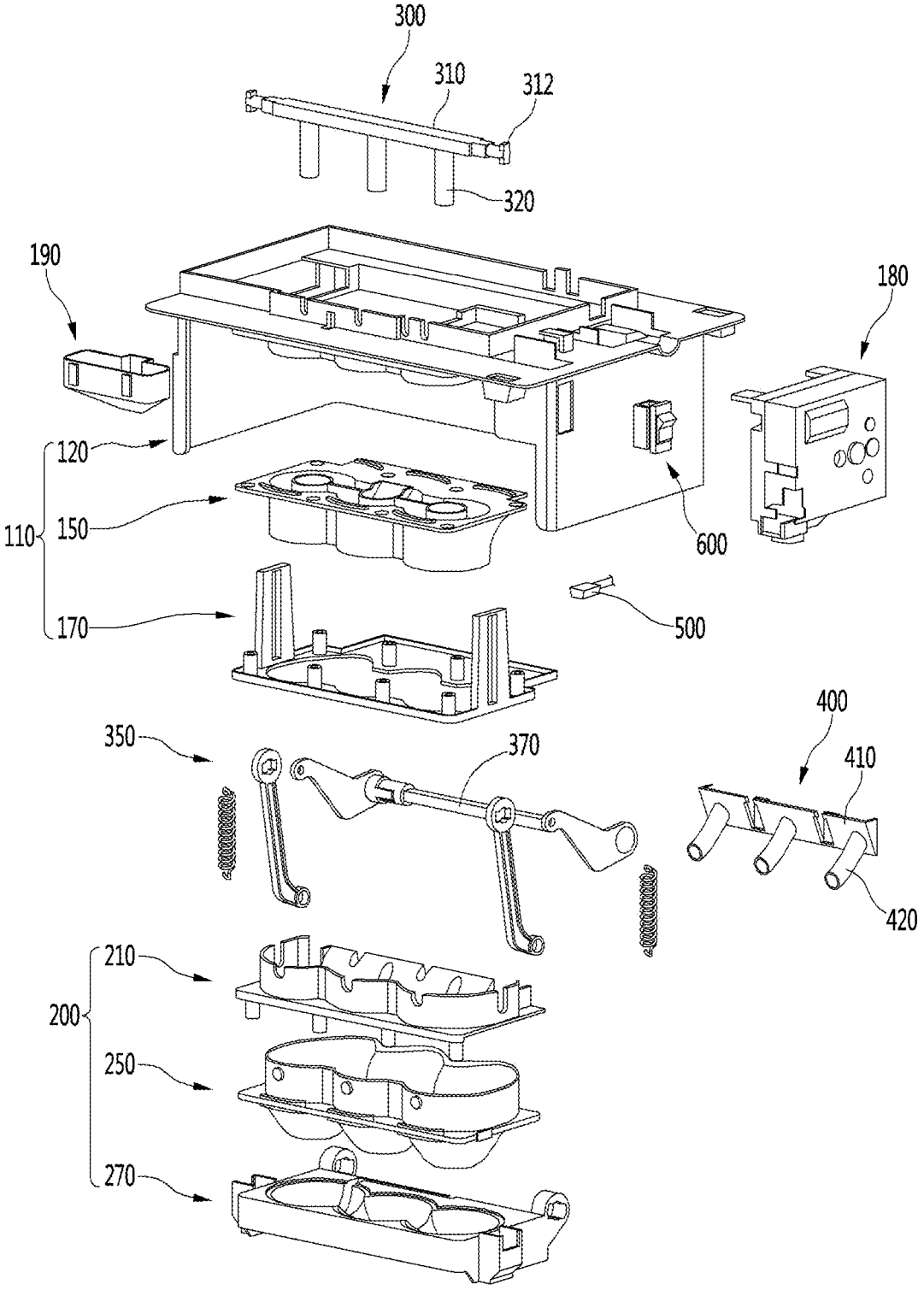
FIG. 5 is an exploded perspective view of the ice maker according to one embodiment of the present disclosure.

FIGS. 3 and 4 are perspective views of an ice maker according to one embodiment of the present disclosure and FIG. 5 is an exploded perspective view of the ice maker according to one embodiment of the present disclosure.

Referring to FIGS. 3 to 5, the ice maker 100 may include an upper assembly 110 and a lower assembly 200.

The lower assembly 200 may rotate with respect to the upper assembly 110. For example, the lower assembly 200 may be rotatably connected to the upper assembly 110, The lower assembly 200 may make spherical ice in cooperation with the upper assembly 110 in a state in which the lower assembly 200 is in contact with the upper assembly 110.

That is, the upper assembly 110 and the lower assembly 200 may define an ice chamber 111 for making the spherical ice. The ice chamber 111 may have a chamber having a substantially spherical shape.

The upper assembly 110 and the lower assembly 200 may define a plurality of ice chambers 111.

Hereinafter, a structure in which three ice chambers are defined by the upper assembly 110 and the lower assembly 200 will be described as an example, and it should be noted that the number of the ice chambers 111 is not limited.

In the state in which the ice chamber 111 is defined by the upper assembly 110 and the lower assembly 200, water is supplied to the ice chamber 111 through a water supply part 190.

The water supply part 190 is coupled to the upper assembly 110 to guide water supplied from the outside to the ice chamber 111.

After the ice is made, the lower assembly 200 may rotate in a forward direction. Thus, the spherical ice made between the upper assembly 110 and the lower assembly 200 may be separated from the upper assembly 110 and the lower assembly 200.

The ice maker 100 may further include a driving unit 180 so that the lower assembly 200 is rotatable with respect to the upper assembly 110.

The driving unit 180 may include a driving motor and a power transmission part for transmitting power of the driving motor to the lower assembly 200. The power transmission part may include one or more gears.

The driving motor may be a bi-directional rotatable motor. Thus, the lower assembly 200 may rotate in both directions.

The ice maker 100 may further include an upper ejector 300 so that the ice is capable of being separated from the upper assembly 110.

The upper ejector 300 may be constructed so that the ice closely attached to the upper assembly 110 is separated from the upper assembly 110.

The upper ejector 300 may include an ejector body 310 and a plurality of upper ejecting pins 320 extending in a direction crossing the ejector body 310.

The upper ejecting pins 320 may be provided in the same number of ice chambers 111. A separation prevention protrusion 312 for preventing a connection unit 350 from being separated in the state of being coupled to a connection unit 350 that will be described later may be provided on each of both ends of the ejector body 310.

For example, the pair of separation prevention protrusions 312 may protrude in opposite directions from the ejector body 310.

While the upper ejecting pin 320 passing through the upper assembly 110 and inserted into the ice chamber 111, the ice within the ice chamber 111 may be pressed.

The ice pressed by the upper ejecting pin 320 may be separated from the upper assembly 110.

Also, the ice maker 100 may further include a lower ejector 400 so that the ice closely attached to the lower assembly 200 is capable of being separated.

The lower ejector 400 may press the lower assembly 200 to separate the ice closely attached to the lower assembly 200 from the lower assembly 200. For example, the lower ejector 400 may be fixed to the upper assembly 110.

The lower ejector 400 may include an ejector body 410 and a plurality of lower ejecting pins 420 protruding from the ejector body 410. The lower ejecting pin 420 may be provided in the same number of ice chambers 111.

While the lower assembly 200 rotates to transfer the ice, rotation force of the lower assembly 200 may be transmitted to the upper ejector 300.

For this, the ice maker 100 may further include the connection unit 350 connecting the lower assembly 200 to the upper ejector 300. The connection unit 350 may include one or more links.

For example, when the lower assembly 200 rotates in one direction, the upper ejecting pin 320 may descend by the connection unit 350 and press the ice.

On the other hand, when the lower assembly 200 rotates in the other direction, the upper ejector 300 may move up and ascend by the connection unit 350 to return to its original position.

Hereinafter, the upper assembly 110 and the lower assembly 120 will be described in more detail.

The upper assembly 110 may include an upper tray 150 defining a portion of the ice chamber 111 making the ice. For example, the upper tray 150 may define an upper portion of the ice chamber 111.

The upper assembly 110 may further include an upper support 170 for fixing a position of the upper tray 150.

For example, the upper supporter 170 may restrict downward movement of the upper tray 150 by supporting the lower portion of the upper tray 150.

The upper assembly 1110 may further include an upper case 120 for fixing a position of the upper tray 150.

The upper tray 150 may be disposed below the upper case 120. A portion of the upper support 170 may be disposed below the upper tray 150.

As described above, the upper case 120, the upper tray 150, and the upper support 170, which are vertically aligned, may be coupled to each other through a coupling member.

That is, the upper tray 150 may be fixed to the upper case 120 through coupling of the coupling member.

For example, the water supply part 190 may be fixed to the upper case 120.

Meanwhile, the lower assembly 200 may include a lower tray 250 defining the other portion of the ice chamber 111 making the ice. For example, the lower tray 250 may define a lower portion of the ice chamber 111.

The lower assembly 200 may further include a lower support 270 for supporting the lower portion of the lower tray 250.

The lower assembly 200 may further include a lower support 210 at least partially supporting the upper portion of the lower tray 250.

The lower case 210, the lower tray 250, and the lower support 270 may be coupled to each other through a coupling member.

The ice maker 100 may further include a switch for turning on/off the ice maker 100. When the user turns on the switch 600, the ice maker 100 may make ice.

That is, an ice making process in which when the switch 600 is turned on, water is supplied to the ice maker 100 and ice is made by cold air, and an ice transfer process in which the lower assembly 200 is rotated and the ice is transferred may be repeatedly performed.

On the other hand, when the switch 600 is manipulated to be turned off, the making of the ice through the ice maker 100 may be impossible. For example, the switch 600 may be provided in the upper case 120.

The ice maker 100 may further include a temperature sensor 500 detecting a temperature of water or a temperature of ice in the upper tray 111.

For example, the temperature sensor 500 can indirectly sense the temperature of water or the temperature of ice in the ice chamber 111 by sensing the temperature of the upper tray 150.

The installation position and structure of the temperature sensor 500 are described below.

<Upper Case>

Figure 6:
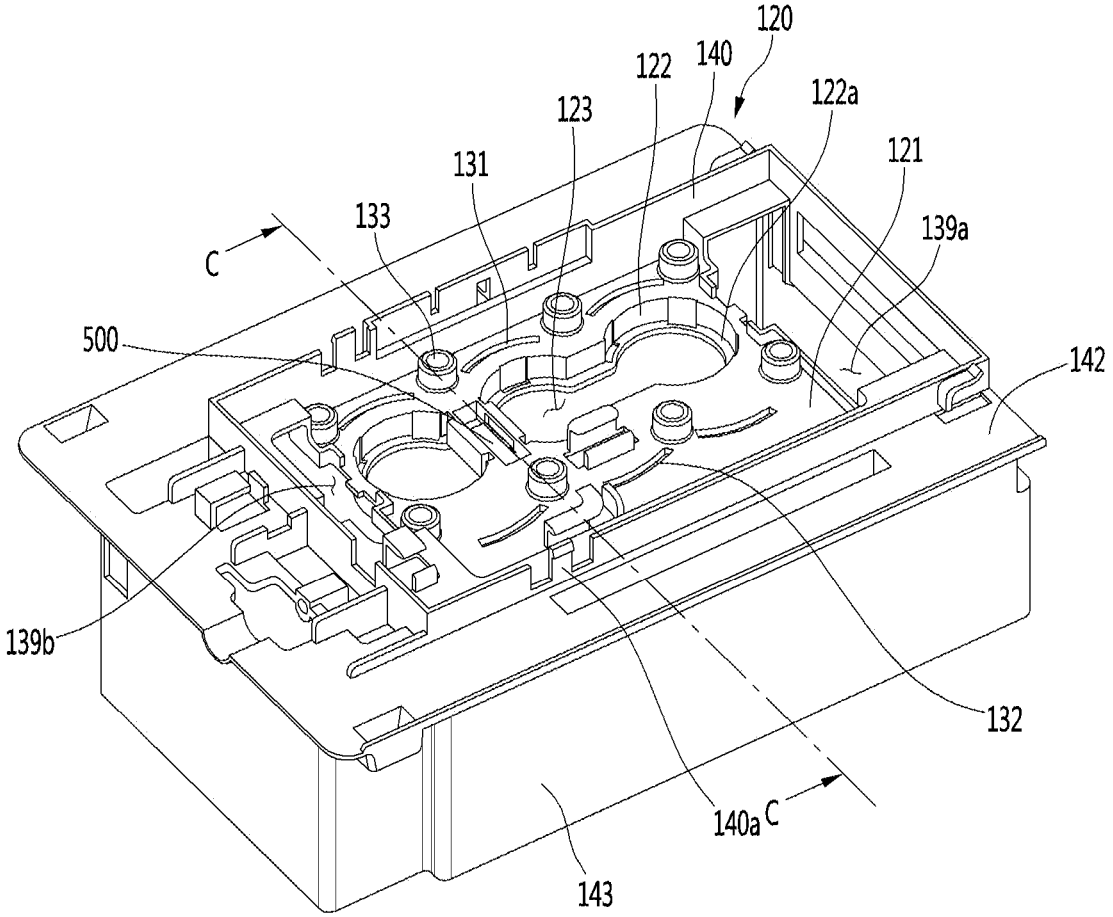
FIG. 6 is an upper perspective view of an upper case according to one embodiment of the present disclosure.
Figure 7:
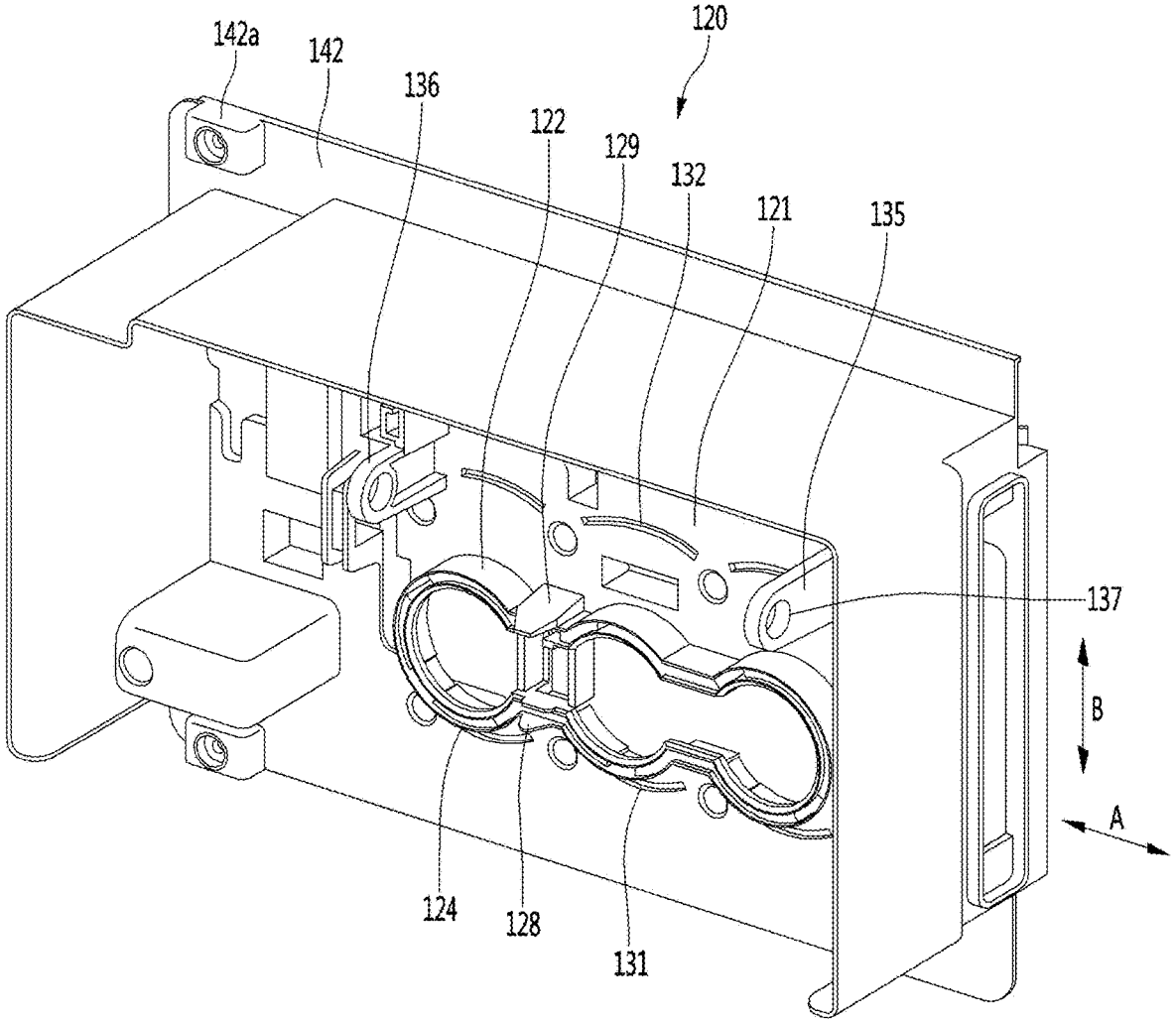
FIG. 7 is a lower perspective view of the upper case according to one embodiment of the present disclosure.

FIG. 6 is an upper perspective view of an upper case according to one embodiment of the present disclosure and FIG. 7 is a lower perspective view of the upper case according to one embodiment of the present disclosure.

Referring to FIGS. 6 and 7, the upper case 120 may be fixed to a housing 101 within the freezing compartment 4 in a state in which the upper tray 150 is fixed.

The upper case 120 may include an upper plate 121 for fixing the upper tray 150.

The upper tray 150 may be fixed to the upper plate 121 in a state in which a portion of the upper tray 150 contacts a bottom surface of the upper plate 121.

An opening 123 through which a portion of the upper tray 150 passes may be defined in the upper plate 121.

For example, when the upper tray 150 is fixed to the upper plate 121 in a state in which the upper tray 150 is disposed below the upper plate 121, a portion of the upper tray 150 may protrude upward from the upper plate 121 through the opening 123.

Alternatively, the upper tray 150 may not protrude upward from the upper plate 121 through opening 123 but protrude downward from the upper plate 121 through the opening 123.

The upper plate 121 may include a recess 122 that is recessed downward. The opening 123 may be defined in a bottom surface 122*a* of the recess 122.

Thus, the upper tray 150 passing through the opening 123 may be disposed in a space defined by the recess 122.

A heater coupling part 124 for coupling an upper heater (see reference numeral 148 of FIG. 11) that heats the upper tray 150 so as to transfer the ice may be provided in the upper case 120

For example, the heater coupling part 124 may be provided on the upper plate 121. The heater coupling part 124 may be disposed below the recess 122.

A plurality of slots 131 and 132 coupled to the upper tray 150 may be provided in the upper plate 121.

A portion of the upper tray 150 may be inserted into the plurality of slots 131 and 132.

The plurality of slots 131 and 132 may include a first upper slot 131 and a second upper slot 132 disposed at an opposite side of the first upper slot 131 with respect to the opening 123.

The opening 123 may be defined between the first upper slot 131 and the second upper slot 132.

The first upper slot 131 and the second upper slot 132 may be spaced apart from each other in a direction of an arrow B of FIG. 7.

Although not limited, the plurality of first upper slots 131 may be arranged to be spaced apart from each other in a direction of an arrow A (hereinafter, referred to as a first direction) that a direction crossing a direction of an arrow B (hereinafter, referred to as a second direction).

Also, the plurality of second upper slots 132 may be arranged to be spaced apart from each other in the direction of an arrow A.

In this specification, the direction of the arrow A may be the same direction as the arranged direction of the plurality of ice chambers 111.

For example, the first upper slot 131 may be defined in a curved shape. Thus, the first upper slot 131 may increase in length.

For example, the second upper slot 132 may be defined in a curved shape. Thus, the second upper slot 133 may increase in length.

When each of the upper slots 131 and 132 increases in length, a protrusion (that is disposed on the upper tray) inserted into each of the upper slots 131 and 132 may increase in length to improve coupling force between the upper tray 150 and the upper case 120.

A distance between the first upper slot 131 and the opening 123 may be different from that between the second upper slot 132 and the opening 123. For example, a distance between the second upper slot 132 and the opening 123 may be shorter than a distance between the first upper slot 131 and the opening 123.

When viewed from the opening 123 toward each of the upper slots 131, a shape that is convexly rounded from each of the slots 131 toward the outside of the opening 123 may be provided.

The upper plate 121 may further include a sleeve 133 into which a coupling boss of the upper support, which will be described later, is inserted.

The sleeve 133 may have a cylindrical shape and extend upward from the upper plate 121.

For example, a plurality of sleeves 133 may be provided on the upper plate 121. The plurality of sleeves 133 may be arranged to be spaced apart from each other in the direction of the arrow A. Also, the plurality of sleeves 133 may be arranged in a plurality of rows in the direction of the arrow B.

A portion of the plurality of sleeves may be disposed between the two first upper slots 131 adjacent to each other.

The other portion of the plurality of sleeves may be disposed between the two second upper slots 132 adjacent to each other or be disposed to face a region between the two second upper slots 132.

The upper case 120 may include a plurality of hinge supports 135 and 136 allowing the lower assembly 200 to rotate.

The plurality of hinge supports 135 and 136 may be disposed to be spaced apart from each other in the direction of the arrow A with respect to FIG. 7. A first hinge hole 137 may be defined in each of the hinge supports 135 and 136.

For example, the plurality of hinge supports 135 and 136 may extend downward from the upper plate 121.

The upper case 120 may further include a vertical extension part 140 vertically extending along a circumference of the upper plate 121. The vertical extension part 140 may extend upward from the upper plate 121.

The vertical extension part 140 may include one or more coupling hooks 140*a*. The upper case 120 may be hook-coupled to the housing 101 by the coupling hooks 140*a*.

The upper case 120 may further include a horizontal extension part 142 horizontally extending to the outside of the vertical extension part 140.

A screw coupling part 142*a* protruding outward to screw-couple the upper case 120 to the housing 101 may be provided on the horizontal extension part 142.

The upper case 120 may further include a side circumferential part 143. The side circumferential part 143 may extend downward from the horizontal extension part 142.

The side circumferential part 143 may be disposed to surround a circumference of the lower assembly 200. That is, the side circumferential part 143 may prevent the lower assembly 200 from being exposed to the outside.

Although the upper case is coupled to the separate housing 101 within the freezing compartment 4 as described above, the embodiment is not limited thereto. For example, the upper case 120 may be directly coupled to a wall defining the freezing compartment 4.

<Upper Tray>

Figure 8:
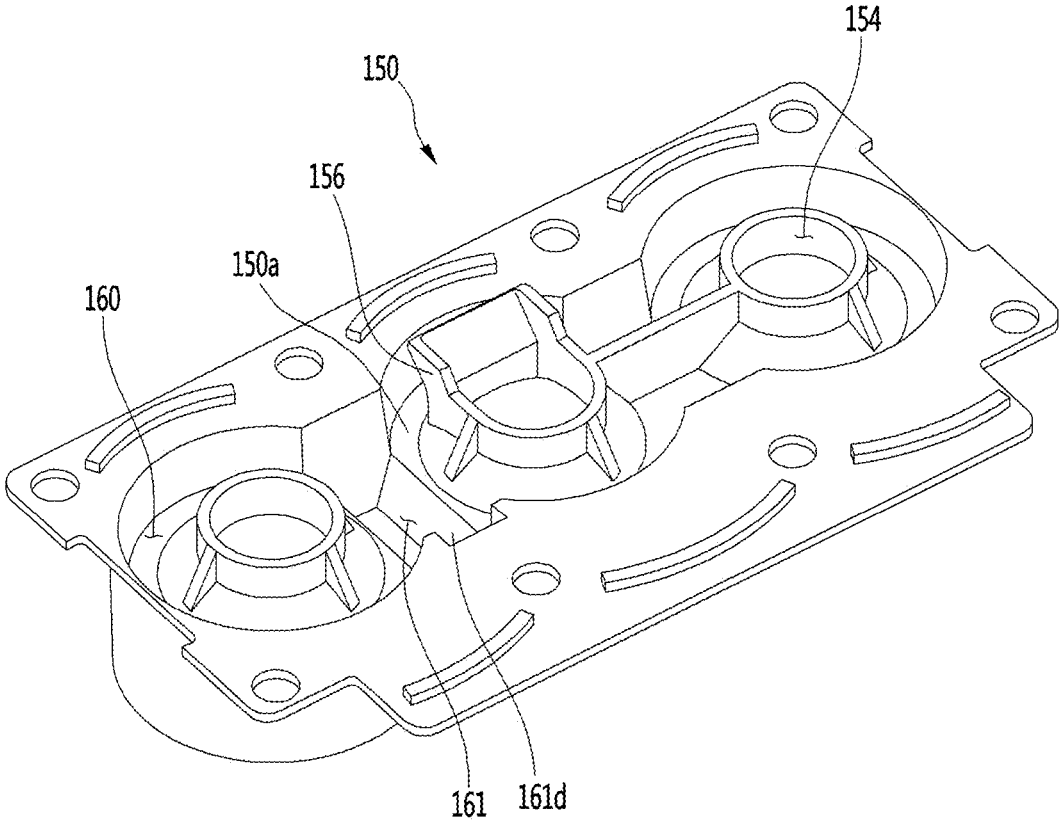
FIG. 8 is an upper perspective view of an upper tray according to one embodiment of the present disclosure.
Figure 9:
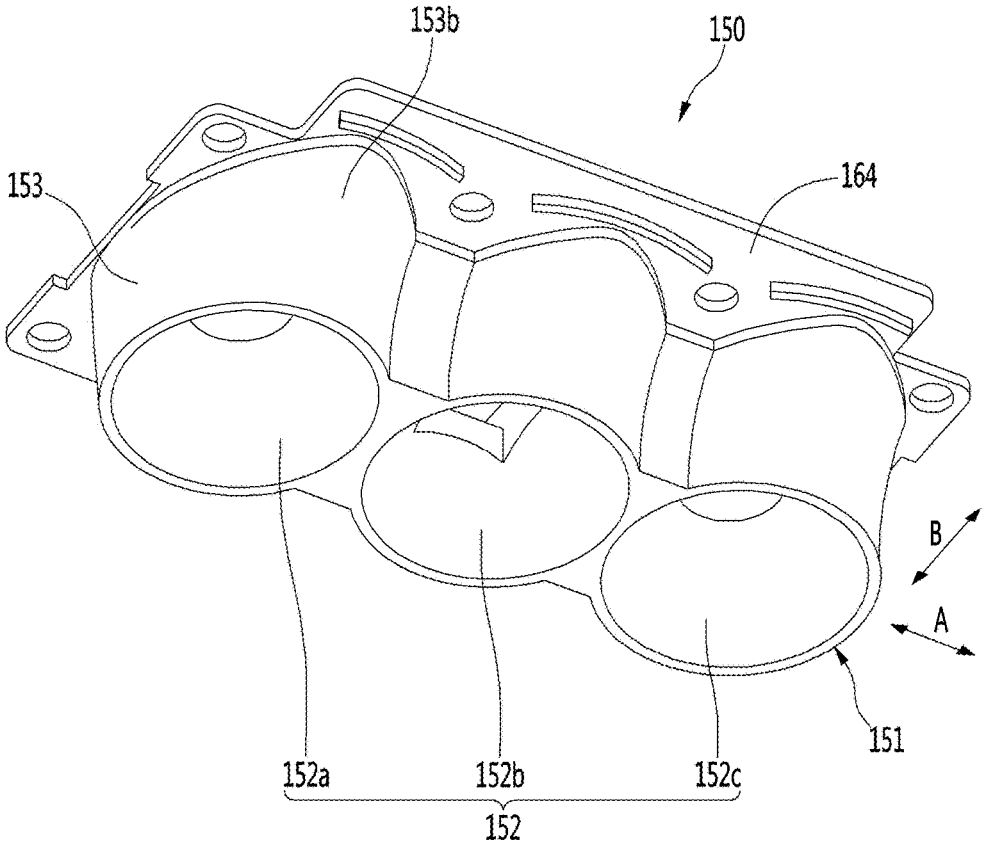
FIG. 9 is a lower perspective view of the upper tray according to one embodiment of the present disclosure.

FIG. 8 is an upper perspective view of an upper tray according to one embodiment of the present disclosure and FIG. 9 is a lower perspective view of the upper tray according to one embodiment of the present disclosure.

Referring to FIGS. 8 and 9, the upper tray 150 may be made of a flexible material that can return to the original shape after being deformed by external force.

For example, the upper tray 150 may be made of a silicone material. Like this embodiment, when the upper tray 150 is made of the silicone material, even though external force is applied to deform the upper tray 150 during the ice transfer process, the upper tray 150 may be restored to its original shape. Thus, in spite of repetitive ice making, spherical ice may be made.

If the upper tray 150 is made of a metal material, when the external force is applied to the upper tray 150 to deform the upper tray 150 itself, the upper tray 150 may not be restored to its original shape any more.

In this case, after the upper tray 150 is deformed in shape, the spherical ice may not be made. That is, it is impossible to repeatedly make the spherical ice.

On the other hand, like this embodiment, when the upper tray 150 is made of the flexible material that is capable of being restored to its original shape, this limitation may be solved.

Also, when the upper tray 150 is made of the silicone material, the upper tray 150 may be prevented from being melted or thermally deformed by heat provided from an upper heater that will be described later.

The upper tray 150 may include a heater accommodation part 160. A heater coupling part 124 of the upper case 120 may be accommodated in the heater accommodation part 160.

Since the upper heater (see reference numeral 148 of FIG. 11) is disposed over the heater coupling part 124, the upper heater (see reference numeral 148 of FIG. 11) ma be considered as being accommodated in the heater accommodation part 160.

The heater accommodation part 160 may be disposed in a shape surrounding the upper chambers 152*a*, 152*b*, and 152*c*. The heater accommodation part 160 may be formed by recessing down the top surface of the upper tray body 151.

The heater accommodation part 160 may be positioned lower than the upper opening 154.

The upper tray 150 may include an upper tray body 151 defining an upper chamber 152 that is a portion of the ice chamber 111.

The upper tray body 151 may define a plurality of upper chambers 152.

For example, the plurality of upper chambers 152 may define a first upper chamber 152*a*, a second upper chamber 152*b*, and a third upper chamber 152*c*.

The upper tray body 151 may include three chamber walls 153 defining three independent upper chambers 152*a*, 152*b*, and 152*c*. The three chamber walls 153 may be connected to each other to form one body.

The first upper chamber 152*a*, the second upper chamber 152*b*, and the third upper chamber 152*c* may be arranged in a line.

For example, the first upper chamber 152*a*, the second upper chamber 152*b*, and the third upper chamber 152*c* may be arranged the direction of the arrow W in FIG. 9.

The upper chamber 152 has a hemispherical shape. That is, an upper portion of the spherical ice may be made by the upper chamber 152.

An upper opening 154 may be defined in an upper side of the upper tray body 151. The upper opening cover 154 may communicate with the upper chamber 152.

For example, three upper openings 154 may be defined in the upper tray body 151.

Cold air may be guided into the ice chamber 111 through the upper opening 154.

Also, water may flow into the ice chamber 111 through the upper opening 154.

In the ice transfer process, the upper ejector 300 may be inserted into the upper chamber 152 through the upper opening 154.

The upper tray 150 may further include a sensor accommodation part 161 in which the temperature sensor is accommodated. For example, the sensor accommodation part 161 may be provided in the upper tray body 151. Although not limited, the sensor accommodation part 161 may be provided by recessing a bottom surface of the heater accommodation part 160 downward.

The sensor accommodation part 161 may be disposed between the two upper chambers adjacent to each other. For example, the second accommodation part 161 may be disposed between the first upper chamber 152*a* and the second upper chamber 152*b*.

Thus, an interference between the upper heater (see reference numeral 148 of FIG. 11) accommodated in the heater accommodation part 160 and the temperature sensor 500 may be prevented.

Figure 10:
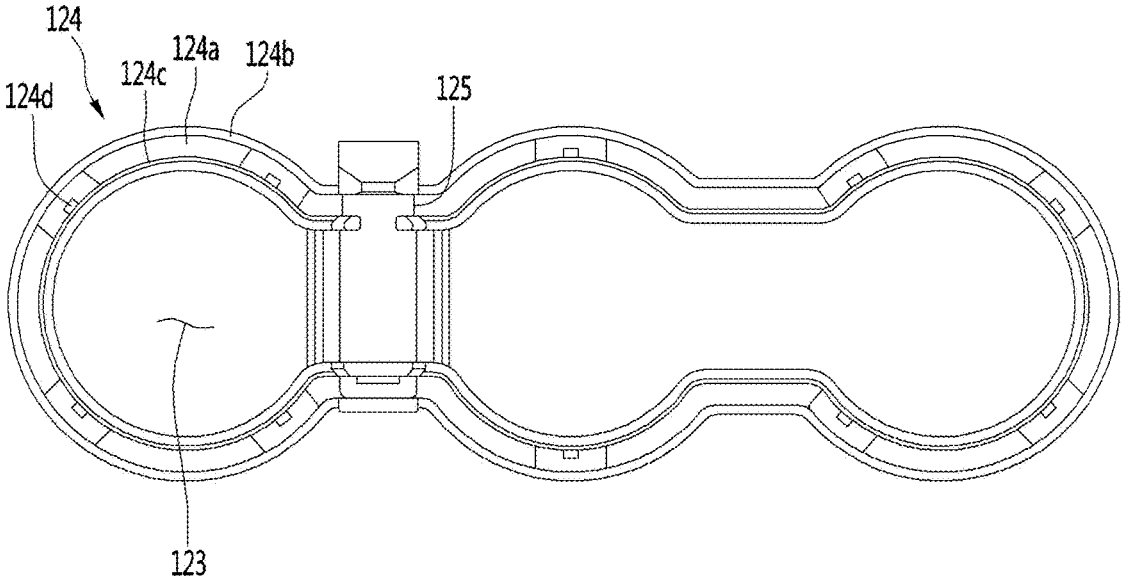
FIG. 10 is an enlarged view of a heater coupling part in the upper case of FIG. 7.
Figure 11:
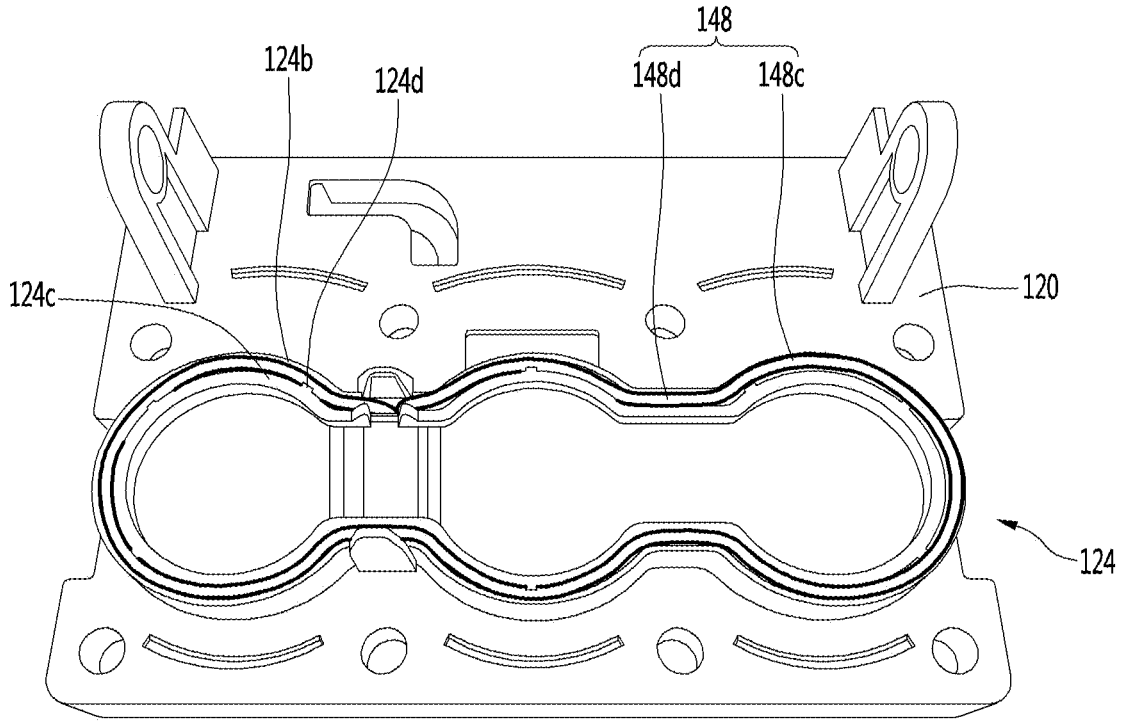
FIG. 11 is a view illustrating a state in which the upper heater is coupled to the upper case of FIG. 7.
Figure 12:
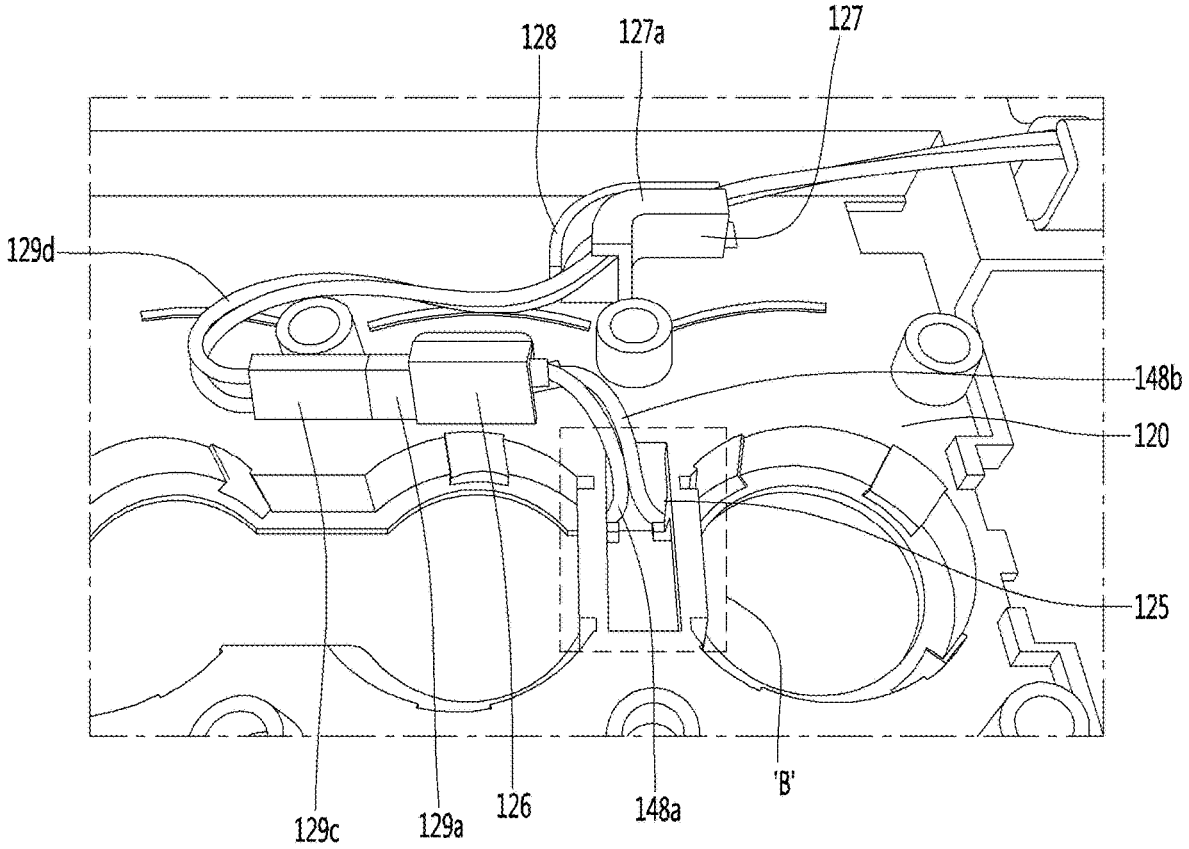
FIG. 12 is a view illustrating an arrangement of a wire connected to the upper heater in the upper case.

FIG. 10 is an enlarged view of the heater coupling part in the upper case of FIG. 7, FIG. 11 is a view illustrating a state in which the upper heater is coupled to the upper case of FIG. 7, and FIG. 12 is a view illustrating an arrangement of a wire connected to the upper heater in the upper case.

Referring to FIGS. 10 to 12, the heater coupling part 124 may include a heater accommodation groove 124*a* accommodating the upper heater 148.

For example, the heater accommodation groove 124*a* may be defined by recessing a portion of a bottom surface of the recess 122 of the upper case 120 upward.

The heater accommodation groove 124*a* may extend along a circumference of the opening 123 of the upper case 120.

For example, the upper heater 148 may be a wire-type heater. Thus, the upper heater 148 may be bendable. The upper heater 148 may be bent to correspond to a shape of the heater accommodation groove 124*a* so as to accommodate the upper heater 148 in the heater accommodation groove 124*a*.

The upper heater 148 may be a DC heater receiving DC power. The upper heater 148 may be turned on to transfer ice. When heat of the upper heater 148 is transferred to the upper tray 150, ice may be separated from a surface (inner face) of the upper tray 150. In this case, the more the intensity of the heat from the upper heater 148, the more the portion facing the upper heater 148 of spherical ice becomes opaque. That is, an opaque band having a shape corresponding to the upper heater is formed around the ice.

However, in the case of this embodiment, since the DC heater having low output is used, the amount of heat transferred to the upper tray 150 decreases, and thus, an opaque band can be prevented from being formed around the ice.

An upper heater 148 may be disposed to surround the circumference of each of the plurality of upper chambers 152 so that the heat of the upper heater 148 is uniformly transferred to the plurality of upper chambers 152 of the upper tray 150. The upper heater 148 may horizontally surround each upper chamber 152.

The upper heater 148 may contact the circumference of each of the chamber walls 153 respectively defining the plurality of upper chambers 152.

Since the heater accommodation groove 124*a* is recessed from the recess 122, the heater accommodation groove 124*a* may be defined by an outer wall 124*b* and an inner wall 124*c*.

The upper heater 148 may have a diameter greater than that of the heater accommodation groove 124*a* so that the upper heater 148 protrudes to the outside of the heater coupling part 124 in the state in which the upper heater 148 is accommodated in the heater accommodation groove 124*a*.

Since a portion of the upper heater 148 protrudes to the outside of the heater accommodation groove 124*a* in the state in which the upper heater 148 is accommodated in the heater accommodation groove 124*a*, the upper heater 148 may contact the upper tray 150.

A separation prevention protrusion 124*d* may be provided on one of the outer wall 124*b* and the inner wall 124*c* to prevent the upper heater 148 accommodated in the heater accommodation groove 124*a* from being separated from the heater accommodation groove 124*a*.

In FIG. 10, for example, a plurality of separation prevention protrusions 124*d* are provided on the inner wall 124*c*.

The separation prevention protrusion 124*d* may protrude from the upper end of the inner wall 124*c* toward the outer wall 124*b*.

Here, a protruding length of the separation prevention protrusion 124*d* may be less than about ½ of a distance between the outer wall 124*b* and the inner wall 124*c* to prevent the upper heater 148 from being easily separated from the heater accommodation groove 124*a* without interfering with the insertion of the upper heater 148 by the separation prevention protrusion 124*d*.

As illustrated in FIG. 11, in the state in which the upper heater 148 is accommodated in the heater accommodation groove 124*a*, the upper heater 148 may be divided into a rounded portion 148*c* and a linear portion 148*d*.

The rounded portion 148*c* may be a portion disposed along the circumference of the upper chamber 152 and also a portion that is bent to be rounded in a horizontal direction.

The liner portion 148*d* may be a portion connecting the rounded portions 148*c* corresponding to the upper chambers 152 to each other.

Since the rounded portion 148*c* of the upper heater 148 may be separated from the heater accommodation groove 124*a*, the separation prevention protrusion 124*d* may be disposed to contact the rounded portion 148*c*.

A through-opening 124*e* may be defined in a bottom surface of the heater accommodation groove 124*a*. When the upper heater 148 is accommodated in the heater accommodation groove 124*a*, a portion of the upper heater 148 may be disposed in the through-opening 124*e*. For example, the through-opening 124*e* may be defined in a portion of the upper heater 148 facing the separation prevention protrusion 124*d*.

When the upper heater 148 is bent to be horizontally rounded, tension of the upper heater 148 may increase to cause disconnection, and also, the upper heater 148 may be separated from the heater accommodation groove 124*a*.

However, when the through-opening 124*e* is defined in the heater accommodation groove 124*a* like this embodiment, a portion of the upper heater 148 may be disposed in the through-opening 124*e* to reduce the tension of the upper heater 148, thereby preventing the heater accommodation groove 124*a* from being separated from the upper heater 148.

As illustrated in FIG. 12, in a state in which a power input terminal 148*a* and a power output terminal 148*b* of the upper heater 148 are disposed in parallel to each other, the upper heater 148 may pass through a heater through-hole 125 defined in the upper case 120.

Since the upper heater 148 is accommodated from a lower side of the upper case 120, the power input terminal 148*a* and the power output terminal 148*b* of the upper heater 148 may extend upward to pass through the heater through-hole 125.

The power input terminal 148*a* and the power output terminal 148*b* passing through the heater through-hole 125 may be connected to one first connector 126.

A second connector 129*c* to which two wires 129*d* connected to correspond to the power input terminal 148*a* and the power output terminal 148*b* are connected may be connected to the first connector 126.

A first guide part 126 guiding the upper heater 148, the first connector 126, the second connector 129*c*, and the wire 129*d* may be provided on the upper plate 121 of the upper case 120.

FIG. 12, for example, a structure in which the first guide part 126 guides the first connector 126 is illustrated.

The first guide part 126 may extend upward from the top surface of the upper plate 121 and have an upper end that is bent in the horizontal direction.

Thus, the upper bent portion of the first guide part 126 may limit upward movement of the first connector 126.

The wire 129*d* may be led out to the outside of the upper case 120 after being bent in an approximately "U" shape to prevent interference with the surrounding structure.

Since the wire 129*d* is bent at least once, the upper case 120 may further include wire guides 127 and 128 for fixing a position of the wire 129*d*.

The wire guides 127 and 128 may include a first guide 127 and a second guide 128, which are disposed to be spaced apart from each other in the horizontal direction. The first guide 127 and the second guide 128 may be bent in a direction corresponding to the bending direction of the wire 129*d* to minimize damage of the wire 129*d* to be bent.

That is, each of the first guide 127 and the second guide 128 may include a curved portion.

To limit upward movement of the wire 129*d* disposed between the first guide 127 and the second guide 128, at least one of the first guide 127 and the second guide 128 may include an upper guide 127*a* extending toward the other guide.

<Temperature Sensor>

Figure 13:
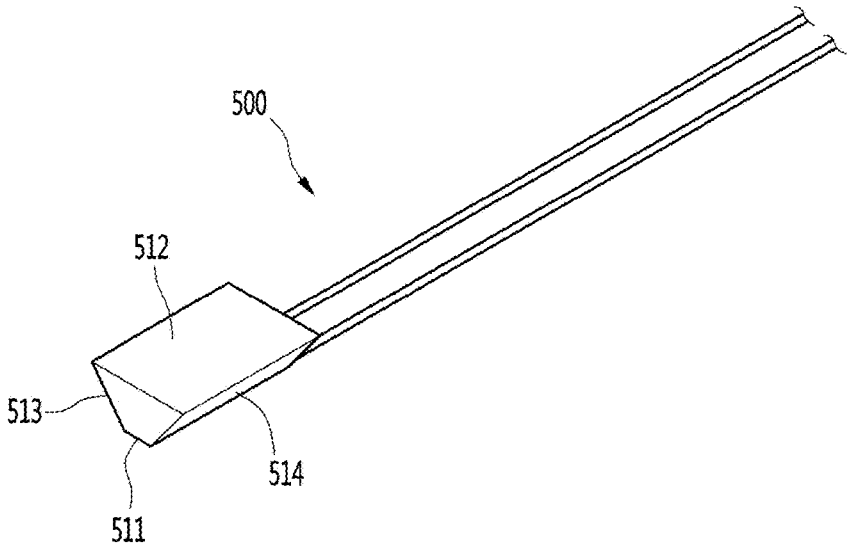
FIG. 13 is a perspective view of a temperature sensor.
Figure 14:
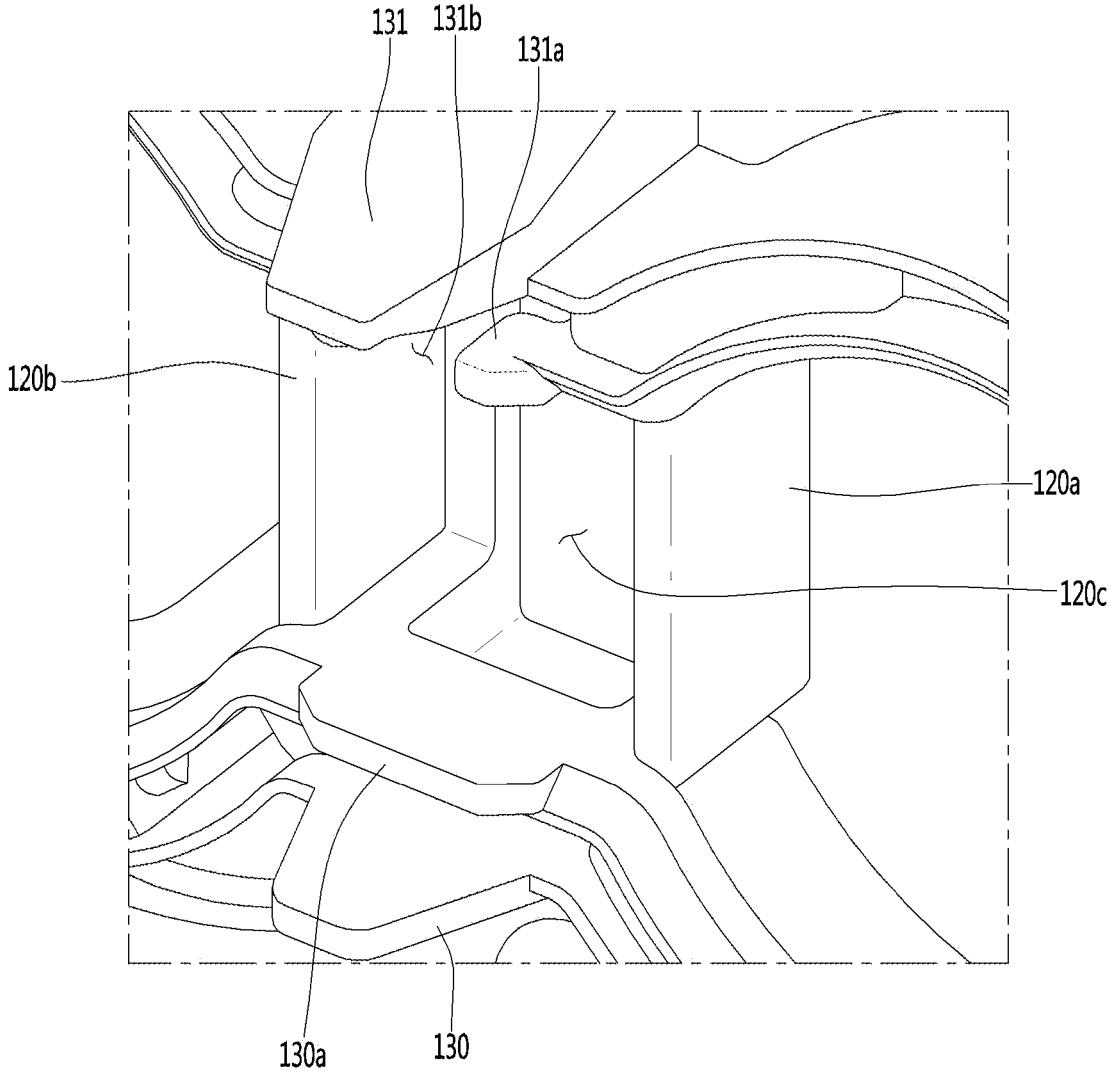
FIG. 14 is a view enlarging the area A of FIG. 7.
Figure 15:
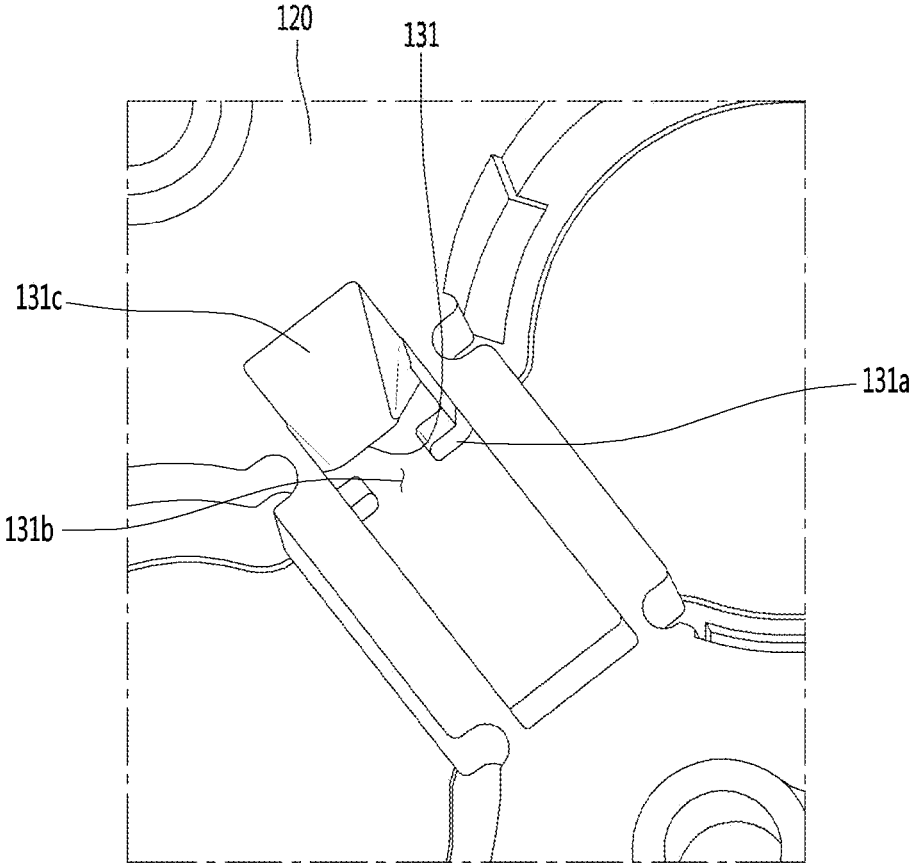
FIG. 15 is a view enlarging the area B of FIG. 12.
Figure 16:
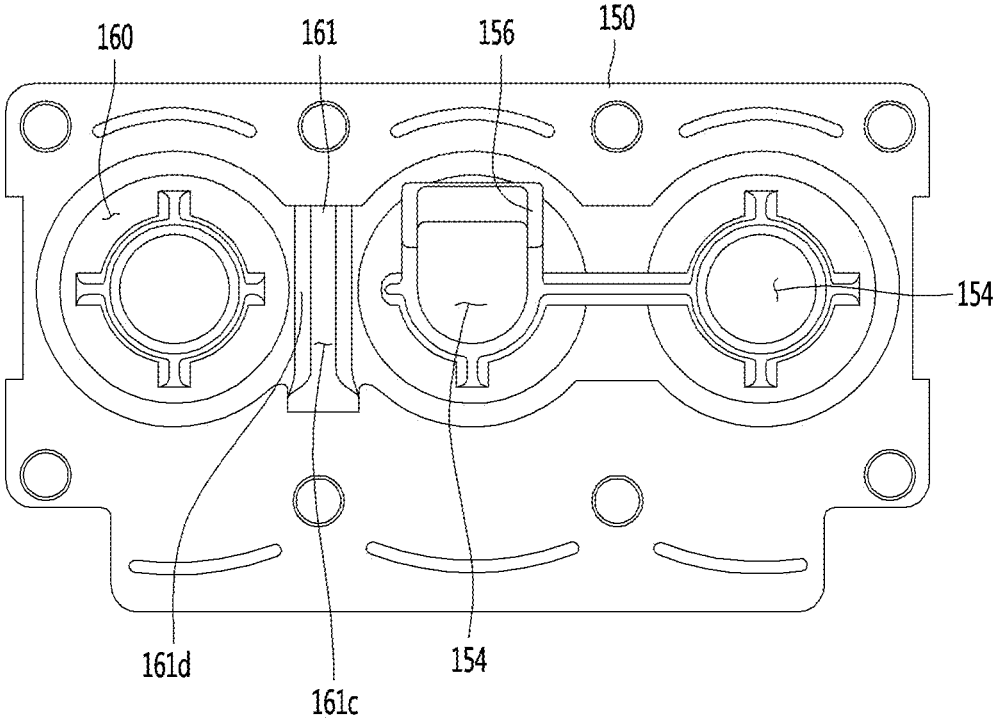
FIG. 16 is a plan view of an upper tray.
Figure 17:
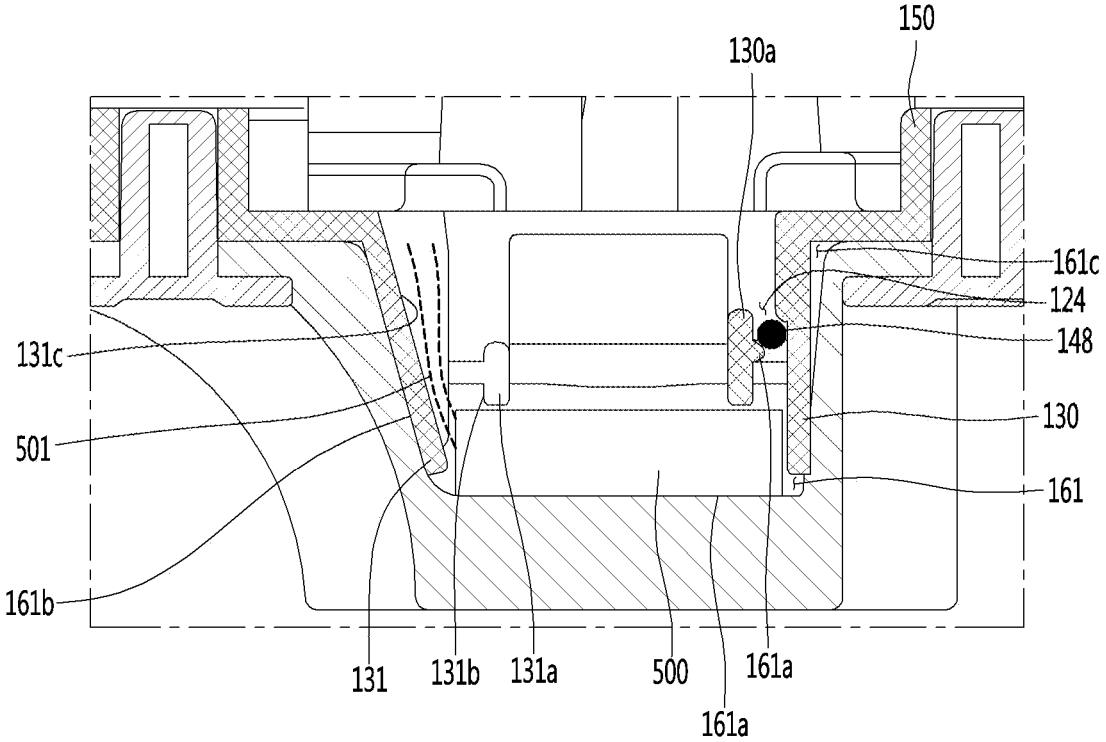
FIG. 17 is a cross-sectional view taken along line C-C of FIG. 6 in a state in which a temperature sensor is mounted.
Figure 18:
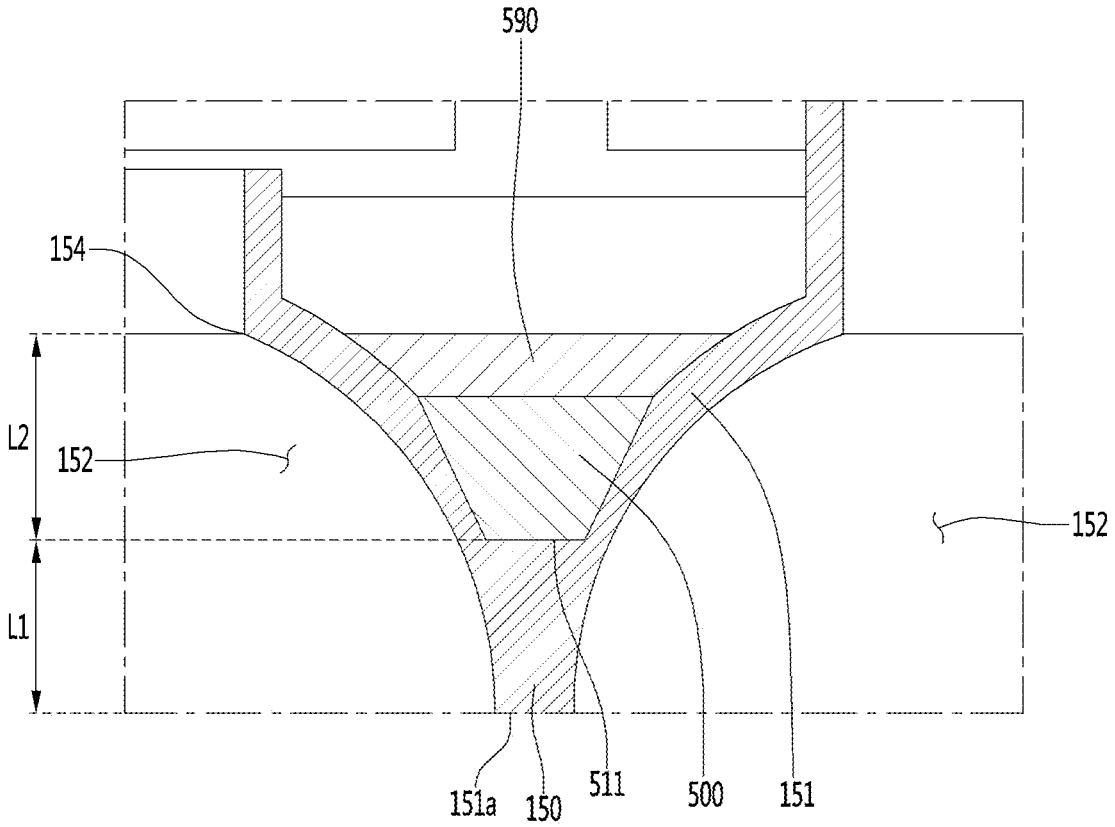
FIG. 18 is a view showing a state in which an insulator is added on the temperature sensor.

FIG. 13 is a perspective view of a temperature sensor. FIG. 14 is a view enlarging the area A of FIG. 7. FIG. 15 is a view enlarging the area B of FIG. 12. FIG. 16 is a plan view of an upper tray. FIG. 17 is a cross-sectional view taken along line C-C of FIG. 6 in a state in which a temperature sensor is mounted and FIG. 18 is a view showing a state in which an insulator is added on the temperature sensor.

Referring to FIGS. 13 to 18, the temperature sensor 500, for example, may be installed in the upper case 120.

The upper case 120 may include a plurality of installation ribs 130 and 131 being in contact with the temperature sensor 100 to install the temperature sensor 500.

In the case of this embodiment, the upper heater 148 and the temperature sensor 500 are mounted in the upper case 120. The installation heights of the upper heater 148 and the temperature sensor 500 may be different to prevent interference between the upper heater 148 and the temperature sensor 500.

Also, the installation heights of the lower heater 296 and the temperature sensor 500 may be different to prevent interference between the lower heater 296 and the temperature sensor 500.

At least a portion of the temperature sensor 500 may vertically overlap the upper heater 148 due to the installation height difference.

The plurality of installation ribs 130 and 131 may include a first installation rib 130 and a second installation rib 131.

The first installation rib 130 and the second installation rib 131 may be spaced apart from each other in a direction crossing the arrangement direction of the plurality of upper chamber 152.

The gap between the first and second ribs 130 and 131 may be smaller than the length of the temperature sensor 500.

Accordingly, in a state in which the temperature sensor 500 is accommodated between the first installation rib 130 and the second installation rib 131, the first installation rib 130 may be in contact with a surface of the temperature sensor 500 and the second installation rib 131 may be in contact with the other surface of the temperature sensor 500.

The first and second installation ribs 130 and 131, for example, may be provided on the upper plate 121.

The upper case 120 may further include one or more bridges 120*a* and 120*b* spaced apart from each other.

The bridges 120*a* and 120*b* are disposed over the opening 123 and prevent a decrease of the gap between the first and second installation ribs 130 and 131 in the upper case 120.

For example, a pair of bridges 120*a* and 120*b* may be arranged in a direction crossing the arrangement direction of the first and second installation ribs 130 and 131.

The bridges 120*a* and 120*b* may be arranged in a direction parallel with the arrangement direction of the first and second installation ribs 130 and 131.

When the upper case 120 and the upper tray 150 are combined in a state in which the temperature sensor 500 is installed in the upper case 120, the temperature sensor 500 may be brought in contact with the upper tray 150. In detail, at least a surface of the temperature sensor 500 may be in surface contact with the upper tray 150.

Referring to FIG. 18, the bottom surface 511 of the temperature sensor 500 may be in surface contact with the upper tray 150. The bottom surface 511 of the temperature sensor 500 may also be referred to as a contact surface.

When the sensor accommodation part 161 is formed on the upper tray body 151, at least a portion of the temperature sensor 500 may be accommodated in the sensor accommodation part 161, and as a result, the temperature sensor 500 may be more stably fixed to the upper tray 150.

Also, when the sensor accommodation part 161 is formed on the upper tray body 151, the portion where the sensor accommodation part 161 is formed become thin, and thus, the temperature sensor 500 can more quickly and accurately measure the temperature of the ice chamber 111 through the small thickness of the bottom surface 161*a* of the sensor accommodation part 161.

The temperature sensor 500 may be disposed not in parallel with the upper heater 148, and thus, interference between the upper heater 148 accommodated in the heater accommodation part 160 and the temperature sensor 500 may be prevented.

Meanwhile, in a state in which the temperature sensor 500 is accommodated in the sensor accommodation part 161, the temperature sensor 500 may be in contact with the outer surface of the upper tray body 151.

A controller not shown may determine whether ice making is completed on the basis of the temperature sensed by the temperature sensor 500.

As described above, the temperature sensor 500 is accommodated in the sensor accommodation part 161 formed on the upper tray 150 and senses temperature by coming in contact with the upper tray 150.

Accordingly, the temperature sensor 500 needs to maintain the contact state with the upper tray 150.

In detail, the temperature sensor 500 may come in surface contact with the thin bottom surface 161*a* of the sensor accommodation part 161. The temperature sensor 500 needs to maintain the contact state with the bottom surface 161*a* of the sensor accommodation part 161.

Accordingly, there is a need for a member for pressing down the temperature sensor 500 from an upper side.

The upper case 120 may further include pressing ribs 130*a* and 131*a* that press the temperature sensor 500 so that the temperature sensor 500 can maintain the contact state with the upper tray 150.

The pressing ribs 130*a* and 131*a* may be disposed between the first installation rib 130 and the second installation rib 131.

For example, a first pressing rib 130*a* and a second pressing rib 131*a* are spaced apart from each other, the first pressing rib 130*a* is formed close to the first installation rib 130, and the second pressing rib 131*a* is formed close to the second installation rib 131.

The installation ribs 130 and 131 and the temperature sensor 500 may be accommodated in the sensor accommodation part 161 in a state in which the temperature sensor 500 is accommodated between the first installation rib 130 and the second installation rib 131.

Accordingly, in a state in which the temperature sensor 500 is accommodated in the sensor accommodation part 161, the pressing ribs 130*a* and 131*a* may press the temperature sensor 500 toward the bottom surface 161*a* of the sensor accommodation part 161 in contact with the top surface of the temperature sensor 500.

When a plurality of pressing ribs 130*a* and 131*a* presses both sides of the temperature sensor 500, as in this embodiment, the temperature sensor 500 may maintain the state in which the entire area is in contact with the upper tray 150, and may more accurately measure the temperature of the ice chamber 111.

Also, the first pressing rib 130*a* or the second pressing rib 131*a* may include slit part 131*b*.

For example, the slit part 121*b* may be formed by cutting the second pressing rib 131*a* with a predetermined width. An inclined surface to be described below may be formed on the second pressing rib 131*a*.

As described above, when the slit part 131*b* is formed at the second pressing rib 131*a*, the wire of the temperature sensor 500 or the upper heater 148 may more easily pass through the slit part 131*b*.

Referring to FIGS. 16 and 17, the temperature sensor 500 is coupled to the upper case 120 in a state in which the upper heater 148 is coupled to the heater coupling part 124. In the state in which the temperature sensor 500 is coupled to the upper case 120, the bottom surface 511 of the temperature sensor 500 is positioned lower than the upper heater 148.

Accordingly, the distance L1 from the bottom surface 151*a* (or a tray contact surface) being in contact with the lower tray 250 of the upper tray 150 to the bottom surface 511 of the temperature sensor 500 (or the contact portion between the upper tray 150 and the temperature sensor 500) is shorter than the distance from the bottom surface 151*a* of the upper tray 150 to the upper heater 148.

Also, the distance L1 from the bottom surface 151*a* of the upper tray 150 to the bottom surface 511 of the temperature sensor 500 is shorter than the distance L2 from the upper opening 154 to the bottom surface 511 of the temperature sensor 500. That is, the contact portion between the temperature sensor 500 and the upper tray 150 may be positioned closer to the contact surface between the upper tray 150 and the lower tray 250 than the upper opening 154 is to said contact surface.

For example, the temperature sensor 500 may be positioned in the area between the upper heater 148 and the lower heater 296 on the basis of the ice chamber 111.

The temperature sensor 500 may be covered at least partially by an insulator 590. For example, the insulator 590 may cover the portion that is exposed to the outside in a state in which the temperature sensor 500 is installed in the upper case 120. For example, the insulator 590 may be in contact at least with the top surface of the temperature sensor 500.

Meanwhile, when the temperature sensor 500 is fitted between the first and second installation ribs 130 and 131, the temperature sensor 500 is forcibly fitted and temporarily assembled by the first and second installation ribs 130 and 131.

In this state, when the upper case 120 and the upper tray 150 are combined, the temperature sensor 500 is accommodated in the sensor accommodation part 161 and pressed by the first and second pressing ribs 130*a* and 131*a* in a state in which the temperature sensor 500 is fitted between the first and second installation ribs 130 and 131, whereby the temperature sensor 500 may come in contact with the bottom 161*a* of the sensor accommodation part 161.

One or more of the first installation rib 130 and the second installation rib 131 may be inclined upward as going outside. For example, the second installation rib 131 may be inclined, and accordingly, the second installation rib 131 may include a first inclined surface 131*c*.

Also, a second inclined surface 161*b* corresponding to the first inclined surface 131 may be formed on a side of the sensor accommodation part 161.

As described above, when the first inclined surface 131*c* is formed on the second installation rib 131, the wire (see reference numeral 501 of FIG. 17) of the temperature sensor 500, etc. may be easily drawn out of the sensor accommodation part 161.

The temperature sensor 500 may include a bottom surface 511 being in contact with the bottom surface 161*a* of the sensor accommodation part 161, a top surface 512 larger than the area of the bottom surface 511, and both inclined surfaces 513 and 514.

For example, the temperature sensor 500 may have a trapezoidal vertical cross-section.

The first and second installation ribs 130 and 131 may be formed in a shape that is the same as or similar to the shape of the temperature sensor 500.

For example, the first and second installation ribs 130 and 131 may have a trapezoidal or triangular cross-section.

Also, the sensor accommodation part 161 may have an open inlet 161*c* at the upper portion.

The sensor accommodation part 161 may have a bottom surface 161*a* having an area smaller than that of the inlet 161*c*, and third and fourth inclined surfaces 161*d* corresponding to the both inclined surfaces 513 and 514.

As described above, when the temperature sensor 500 has a shape of which the cross-sectional area gradually increases upward from a lower side and the sensor accommodation part 161 corresponds to the shape, there is the advantage that the temperature sensor 500 can be easily fitted downward from an upper side.

Hereafter, an ice making process by the ice maker according to an embodiment of the present disclosure is described.

Figure 19:
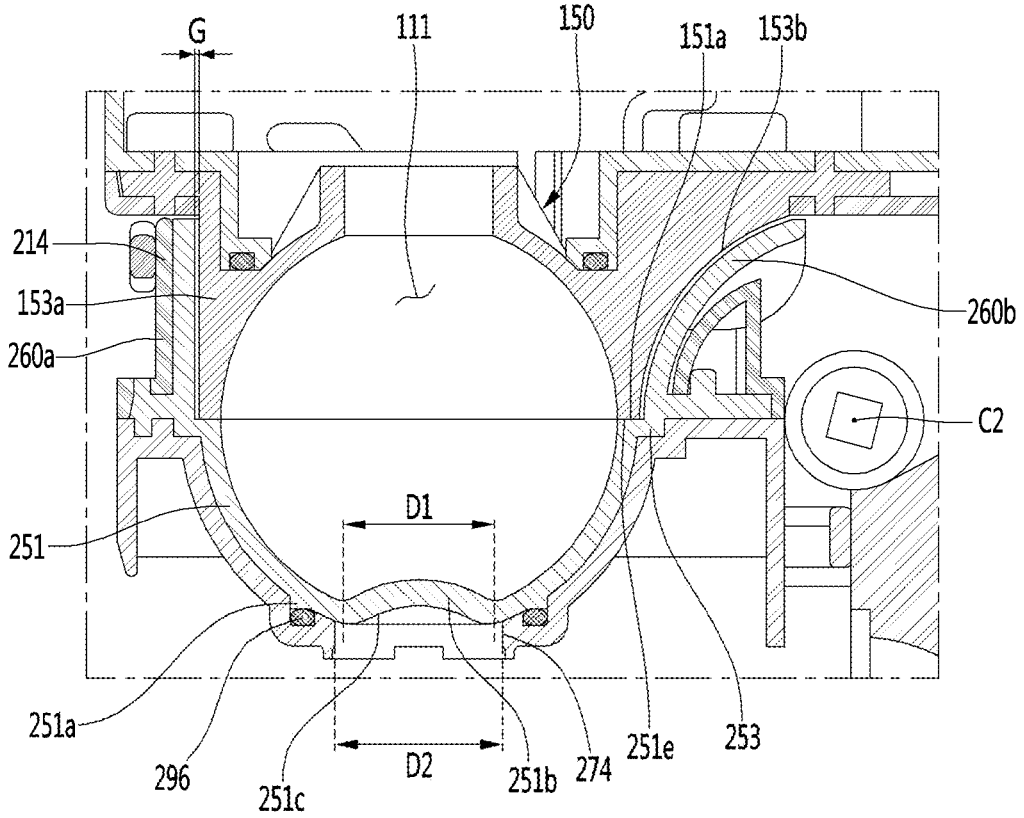
FIG. 19 is a cross-sectional view taken along line A-A of FIG. 3.
Figure 20:
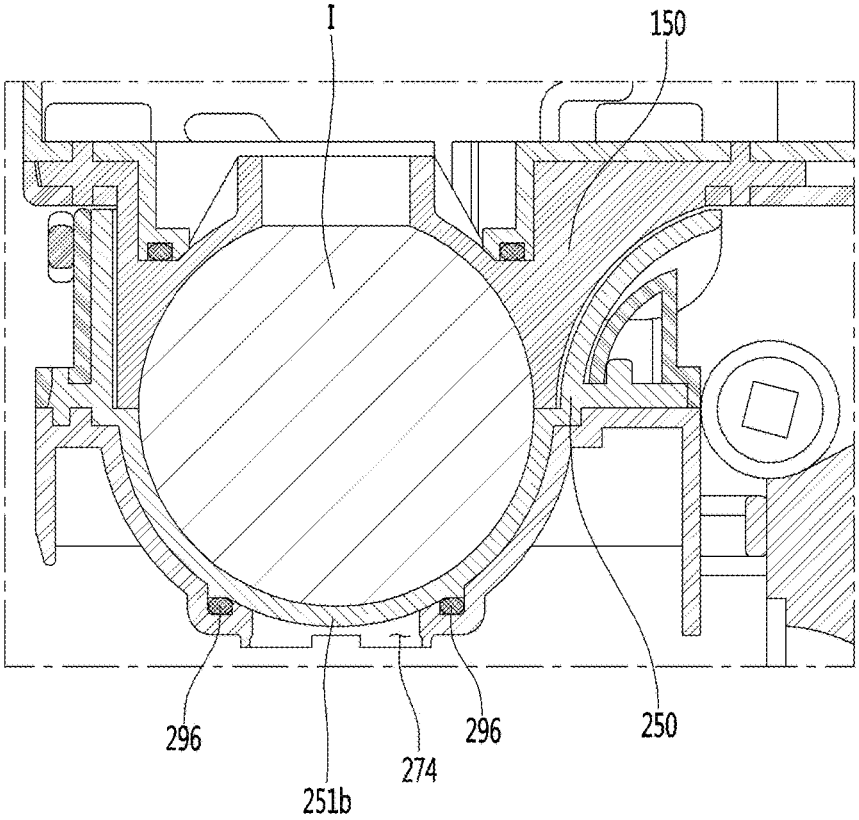
FIG. 20 is a view showing a state in which ice-making is finished in the view of FIG. 19.

FIG. 19 is a cross-sectional view taken along line A-A of FIG. 3 and FIG. 20 is a view showing a state in which ice-making is finished in the view of FIG. 19.

In FIG. 19, a state in which the upper tray and the lower tray contact each other is illustrated.

Referring to FIGS. 19 and 20, the upper tray 150 and the lower tray 250 vertically contact each other to complete the ice chamber 111.

The bottom surface 151*a* of the upper tray body 151 contacts the top surface 251*e* of the lower tray body 251.

Here, in the state in which the top surface 251*e* of the lower tray body 251 contacts the bottom surface 151*a* of the upper tray body 151, elastic force of the elastic member 360 is applied to the lower support 270.

The elastic force of the elastic member 360 may be applied to the lower tray 250 by the lower support 270, and thus, the top surface 251*e* of the lower tray body 251 may press the bottom surface 151*a* of the upper tray body 151.

Thus, in the state in which the top surface 251*e* of the lower tray body 251 contacts the bottom surface 151*a* of the upper tray body 151, the surfaces may be pressed with respect to each other to improve the adhesion.

As described above, when the adhesion between the top surface 251*e* of the lower tray body 251 and the bottom surface 151*a* of the upper tray increases, a gap between the two surface may not occur to prevent ice having a thin band shape along a circumference of the spherical ice from being made after the ice making is completed.

The first extension part 253 of the lower tray 250 is seated on the top surface 271*a* of the support body 271 of the lower support 270. The second extension wall 286 of the lower support 270 contacts a side surface of the first extension part 253 of the lower tray 250.

The second extension part 254 of the lower tray 250 may be seated on the second extension wall 286 of the lower support 270.

In the state in which the bottom surface 151*a* of the upper tray body 151 is seated on the top surface 251*e* of the lower tray body 251, the upper tray body 151 may be accommodated in an inner space of the circumferential wall 260 of the lower tray 250.

Here, the vertical wall 153*a* of the upper tray body 151 may be disposed to face the vertical wall 260*a* of the lower tray 250, and the curved wall 153*b* of the upper tray body 151 may be disposed to face the curved wall 260*b* of the lower tray 250.

An outer face of the upper chamber wall 153 of the upper tray body 151 is spaced apart from an inner face of the circumferential wall 260 of the lower tray 250. That is, a space may be defined between the outer face of the upper chamber wall 153 of the upper tray body 151 and the inner face of the circumferential wall 260 of the lower tray 250.

Water supplied through the water supply part 180 is accommodated in the ice chamber 111. When a relatively large amount of water than a volume of the ice chamber 111 is supplied, water that is not accommodated in the ice chamber 111 may flow into the gap between the outer face of the upper chamber wall 153 of the upper tray body 151 and the inner face of the circumferential wall 260 of the lower tray 250.

Thus, according to this embodiment, even though a relatively large amount of water than the volume of the ice chamber 111 is supplied, the water may be prevented from overflowing from the ice maker 100.

Meanwhile, as described above, a heater contact part 251*a* for allowing the contact area with the lower heater 296 to increase may be further provided on the lower tray body 251.

The heater contact portion 251*a* may protrude from the bottom face of the lower tray body 251. In one example, the heater contact portion 251*a* may protrude from a chamber wall 252*d* having a rounded outer surface.

The heater contact portion 251*a* may be formed in the form of a ring. The bottom face of the heater contact portion 251*a* may be planar. Thus, the heater contact portion 251*a* may be in face-contact with the lower heater 296.

Although not limited, in the state in which the lower heater 296 contacts the heater contact part 251*a*, the lower heater 296 may be disposed lower than an intermediate point of a height of the lower chamber 252.

A portion of the heater contact portion 251*a* may be located between the top face of the inner wall 291*a* and the top face of the outer wall 291*b* while the heater contact portion 251*a* is in contact with the lower heater 296.

The lower tray body 251 may further include a convex portion 251*b* in which a portion of the lower portion of the lower tray body 251 is convex upward. In one example, the lower chamber wall 252*d* may include the convex portion 251*b*.

That is, the convex portion 251*b* may be constructed to be convex toward the center of the ice chamber 111.

In another aspect, the convex portion 251*b* may be convex in a direction away from the lower opening 274 of the lower support 270.

A recess 251*c* may be defined below the convex portion 251*b* so that the convex portion 251*b* has substantially the same thickness as the other portion of the lower tray body 251.

In this specification, the "substantially the same" is a concept that includes completely the same shape and a shape that is not similar but there is little difference.

The convex portion 251*b* may be disposed to vertically face the lower opening 274 of the lower support 270. The heater contact portion 251*a* may be constructed to surround the convex portion 251*b*.

The lower opening 274 may be defined just below the lower chamber 252. That is, the lower opening 274 may be defined just below the convex portion 251*b*.

The diameter D2 of the lower opening 274 may be smaller than the radius of the ice chamber 111 so that the contact area between the lower support 270 and the lower tray 250 is increased.

The convex portion 251*b* may have a diameter D1 less than that D2 of the lower opening 274.

When cold air is supplied to the ice chamber 111 in the state in which the water is supplied to the ice chamber 111, the liquid water is phase-changed into solid ice. Here, the water may be expanded while the water is changed in phase. The expansive force of the water may be transmitted to each of the upper tray body 151 and the lower tray body 251.

In case of this embodiment, although other portions of the lower tray body 251 are surrounded by the support body 271, a portion (hereinafter, referred to as a "corresponding portion") corresponding to the lower opening 274 of the support body 271 is not surrounded.

If the lower tray body 251 has a complete hemispherical shape, when the expansive force of the water is applied to the corresponding portion of the lower tray body 251 corresponding to the lower opening 274, the corresponding portion of the lower tray body 251 is deformed toward the lower opening 274.

In this case, although the water supplied to the ice chamber 111 exists in the spherical shape before the ice is made, the corresponding portion of the lower tray body 251 is deformed after the ice is made. Thus, additional ice having a projection shape may be made from the spherical ice by a space occurring by the deformation of the corresponding portion.

Thus, in this embodiment, the convex portion 251*b* may be disposed on the lower tray body 251 in consideration of the deformation of the lower tray body 251 so that the ice has the completely spherical shape.

In this embodiment, the water supplied to the ice chamber 111 may not have a spherical shape before the ice is made. However, after the ice is completely made, the convex portion 251*b* of the lower tray body 251 may move toward the lower opening 274, and thus, the spherical ice may be made.

In the present embodiment, the convex portion 251*b* is formed. As the recess 251*c* is formed below the convex portion 251*b*, deformation of the convex portion 251*b* may be facilitated. Further, after the convex portion 251*b* is deformed into the recess 251*c*, the convex portion 251*b* may be easily restored to its original shape when the external force is removed.

Hereafter, an ice making process by the ice maker according to an embodiment of the present disclosure is described.

Figure 21:
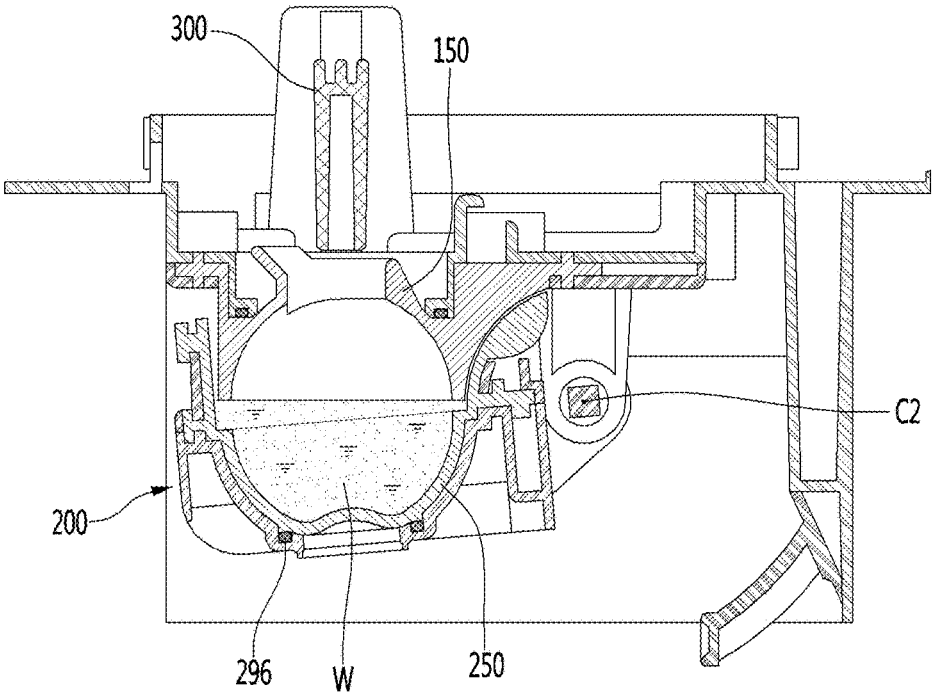
FIG. 21 is a cross-sectional view taken along line B-B of FIG. 3 in a water supply state.
Figure 22:
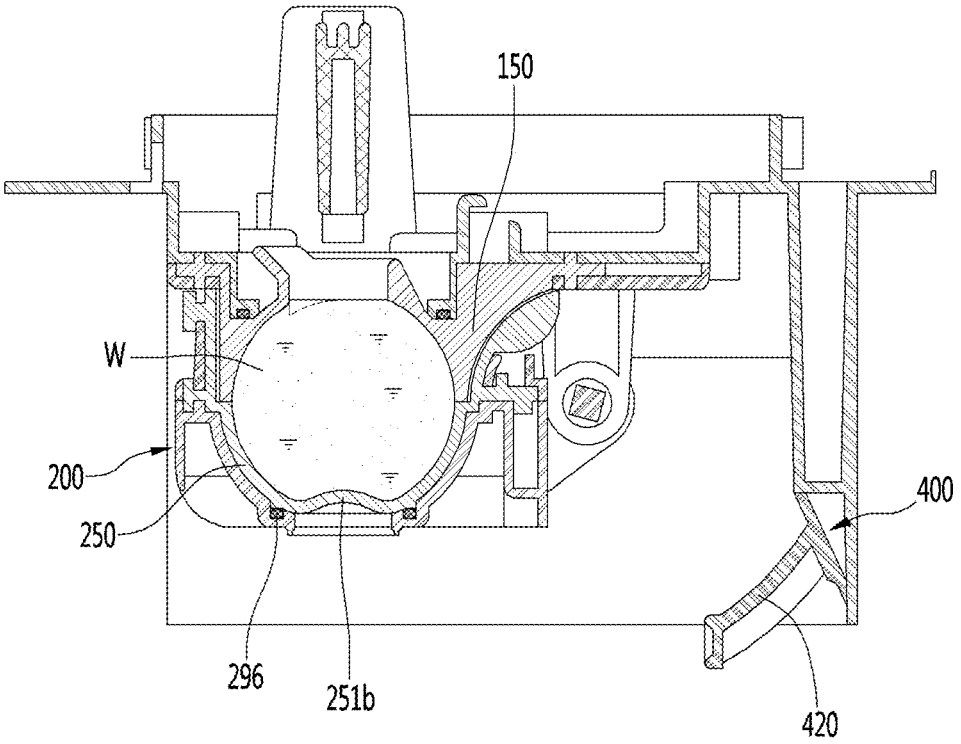
FIG. 22 is a cross-sectional view taken along line B-B of FIG. 3 in an ice making state.

FIG. 21 is a cross-sectional view taken along line B-B of FIG. 3 in a water supply state and FIG. 22 is a cross-sectional view taken along line B-B of FIG. 3 in an ice making state.

Figure 23:
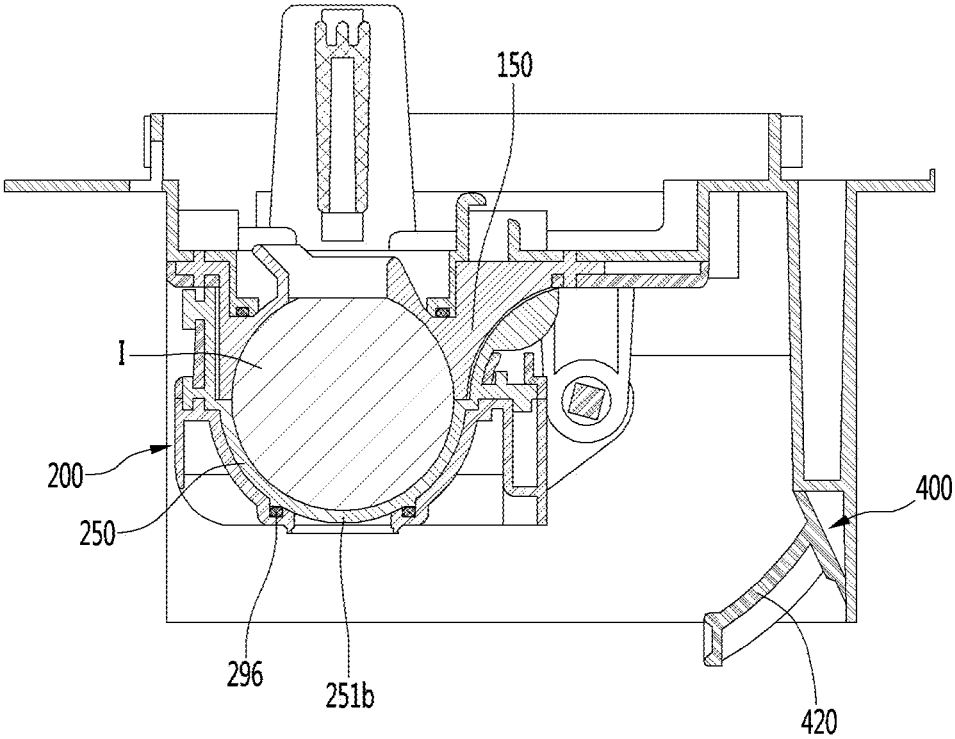
FIG. 23 is a cross-sectional view taken along line B-B of FIG. 3 in an ice making completion state.
Figure 24:
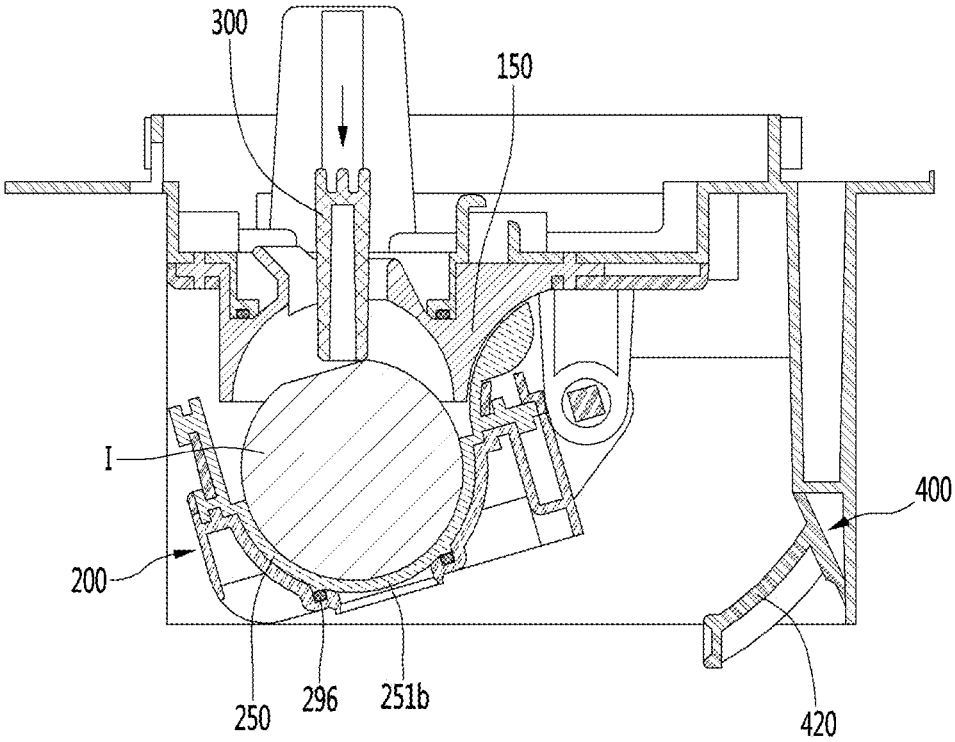
FIG. 24 is a cross-sectional view taken along line B-B of FIG. 3 in an early ice transfer state.
Figure 25:
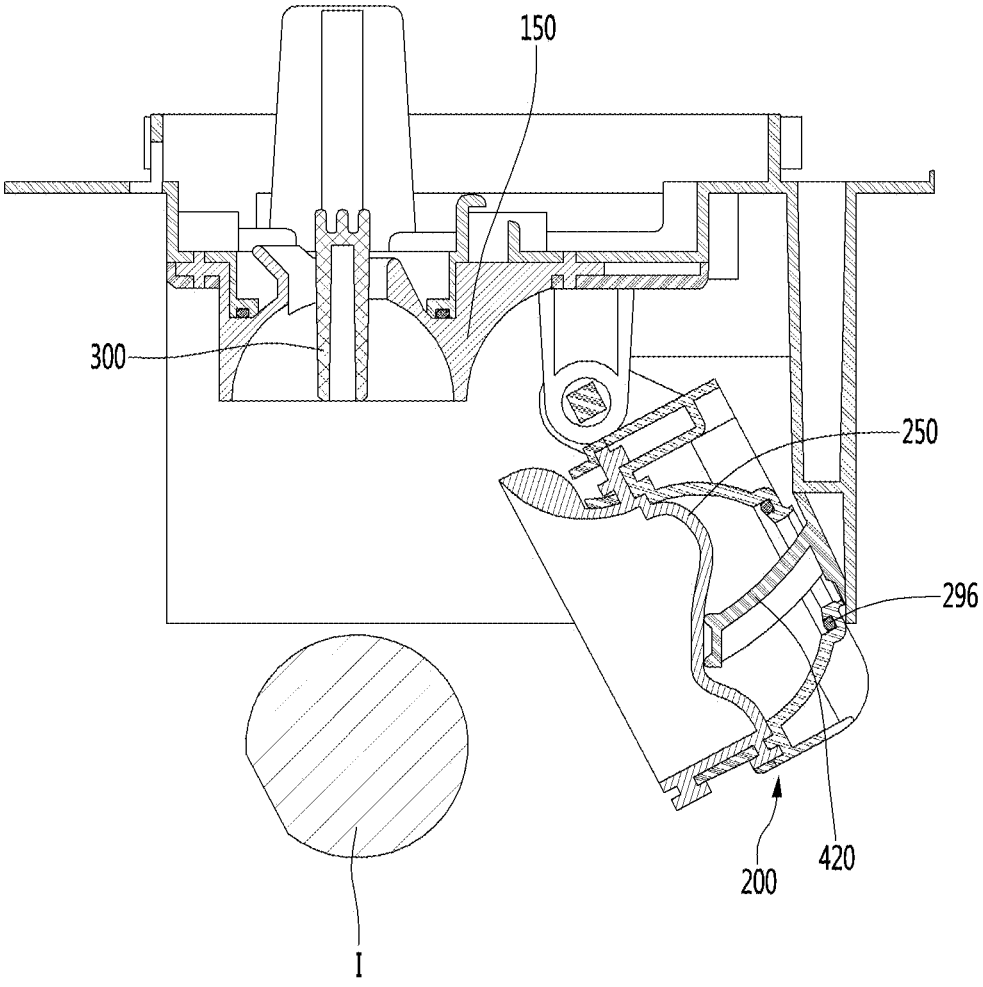
FIG. 25 is a cross-sectional view taken along line B-B of FIG. 3 in an ice transfer completion state.

FIG. 23 is a cross-sectional view taken along line B-B of FIG. 3 in an ice making completion state, FIG. 24 is a cross-sectional view taken along line B-B of FIG. 3 in an early ice transfer state, FIG. 25 is a cross-sectional view taken along line B-B of FIG. 3 in an ice transfer completion state.

Referring to FIGS. 21 to 25, first, the lower assembly 200 rotates to a water supply position.

The top surface 251*e* of the lower tray 250 is spaced apart from the bottom surface 151*e* of the upper tray 150 at the water supply position of the lower assembly 200.

Although not limited, the bottom surface 151*a* of the upper tray 150 may be disposed at a height that is equal or similar to a rotational center C2 of the lower assembly 200

In this embodiment, the direction in which the lower assembly 200 rotates (in a counterclockwise direction in the drawing) is referred to as a forward direction, and the opposite direction (in a clockwise direction) is referred to as a reverse direction.

Although not limited, an angle between the top surface 251*e* of the lower tray 250 and the bottom surface 151*e* of the upper tray 150 at the water supply position of the lower assembly 200 may be about 8 degrees.

In this state, the water is guided by the water supply part 190 and supplied to the ice chamber 111.

Here, the water is supplied to the ice chamber 111 through one upper opening of the plurality of upper openings 154 of the upper tray 150.

In the state in which the supply of the water is completed, a portion of the supplied water may be fully filled into the lower chamber 252, and the other portion of the supplied water may be fully filled into the space between the upper tray 150 and the lower tray 250.

For example, the upper chamber 151 may have the same volume as that of the space between the upper tray 150 and the lower tray 250. Thus, the water between the upper tray 150 and the lower tray 250 may be fully filled in the upper tray 150. In another example, the volume of the upper chamber 152 may be larger than the volume of the space between the upper tray 150 and the lower tray 250.

In case of this embodiment, a channel for communication between the three lower chambers 252 may be provided in the lower tray 250.

As described above, although the channel for the flow of the water is not provided in the lower tray 250, since the top surface 251*e* of the lower tray 250 and the bottom surface 151*a* of the upper tray 150 are spaced apart from each other, the water may flow to the other lower chamber along the top surface 251*e* of the lower tray 250 when the water is fully filled in a specific lower chamber in the water supply process.

Thus, the water may be fully filled in each of the plurality of lower chambers 252 of the lower tray 250.

In the case of this embodiment, since the channel for the communication between the lower chambers 252 is not provided in the lower tray 250, additional ice having a projection shape around the ice after the ice making process may be prevented being made.

In the state in which the supply of the water is completed, as illustrated in FIG. 22, the lower assembly 200 rotates reversely. When the lower assembly 200 rotates reversely, the top surface 251*e* of the lower tray 250 is close to the bottom surface 151*a* of the upper tray 150.

Thus, the water between the top surface 251*e* of the lower tray 250 and the bottom surface 151*a* of the upper tray 150 may be divided and distributed into the plurality of upper chambers 152.

Also, when the top surface 251*e* of the lower tray 250 and the bottom surface 151*a* of the upper tray 150 are closely attached to each other, the water may be fully filled in the upper chamber 152.

In the state in which the top surface 251*e* of the lower tray 250 and the bottom surface 151*e* of the upper tray 150 are closely attached to each other, a position of the lower assembly 200 may be called an ice making position.

In the state in which the lower assembly 200 moves to the ice making position, ice making is started.

Since pressing force of water during ice making is less than the force for deforming the convex portion 251*b* of the lower tray 250, the convex portion 251*b* may not be deformed to maintain its original shape.

When the ice making is started, the lower heater 296 is turned on. When the lower heater 296 is turned on, heat of the lower heater 296 is transferred to the lower tray 250.

In the case of this embodiment, since the temperature sensor 500 is disposed in contact with the upper tray 150, the amount of heat transferring from the lower heater 296 to the temperature sensor 500 is minimized, temperature sensor accuracy of the temperature sensor 500 may be improved.

When the ice making is performed in the state where the lower heater 296 is turned on, ice may be made from the upper side in the ice chamber 111.

That is, water in a portion adjacent to the upper opening 154 in the ice chamber 111 is first frozen. Since ice is made from the upper side in the ice chamber 111, the bubbles in the ice chamber 111 may move downward.

In the present embodiment, the output of the lower heater 296 may vary depending on the mass per unit height of water in the ice chamber 111.

If the heating amount of the lower heater 296 is constant, a rate at which ice is generated per unit height may vary since the mass per unit height of water may vary in the ice chamber 111.

For example, when the mass per unit height of water is small, the rate of ice formation is fast, whereas when the mass per unit height of water is large, the rate of ice generation is slow.

If the rate of ice generation per unit height of the water is not constant, the transparency of the ice may vary as a height varies. In particular, when ice is generated at a high rate, bubbles may not move from the ice to the water, and the thus formed ice may include bubbles therein, thereby lowering transparency.

Thus, in the present embodiment, the output of the lower heater 296 may be controlled based on the mass per unit height of water in the ice chamber 111.

When the ice chamber 111 is formed in a sphere shape, the mass per unit height of water increases from the upper side to the lower side, and then the maximum at the boundary of the upper tray 150 and the lower tray 250 decreases to the lower side again.

Thus, in the case of the present embodiment, the output of the lower heater 296 may decrease initially and then increase.

While ice is continuously made from the upper side to the lower side in the ice chamber 111, the ice may contact a top surface of a block part 251*b* of the lower tray 250.

In this state, when the ice is continuously made, the block part 251*b* may be pressed and deformed as shown in FIG. 23, and the spherical ice may be made when the ice making is completed.

A controller not shown may determine whether ice making is completed on the basis of the temperature sensed by the temperature sensor 500. For example, when temperature sensed by the temperature sensor 500 reaches a reference temperature, it is possible to determine that ice making is completed.

The lower heater 296 may be turned off at the ice-making completion or before the ice-making completion.

When the ice-making is completed, the upper heater 148 is first turned on for the ice-removal of the ice. When the upper heater 148 is turned on, the heat of the upper heater 148 is transferred to the upper tray 150, and thus, the ice may be separated from the surface (the inner face) of the upper tray 150.

After the upper heater 148 has been activated for a set time duration, the upper heater 148 may be turned off and then the drive unit 180 may be operated to rotate the lower assembly 200 in a forward direction.

As illustrated in FIG. 24, when the lower assembly 200 rotates forward, the lower tray 250 may be spaced apart from the upper tray 150.

Also, the rotation force of the lower assembly 200 may be transmitted to the upper ejector 300 by the connection unit 350. Thus, the upper ejector 300 descends by the unit guides 181 and 182, and the upper ejecting pin 320 may be inserted into the upper chamber 152 through the upper opening 154.

In the ice transfer process, the ice may be separated from the upper tray 250 before the upper ejecting pin 320 presses the ice. That is, the ice may be separated from the surface of the upper tray 150 by the heat of the upper heater 148.

In this case, the ice may rotate together with the lower assembly 200 in the state of being supported by the lower tray 250.

Alternatively, even though the heat of the upper heater 148 is applied to the upper tray 150, the ice may not be separated from the surface of the upper tray 150.

Thus, when the lower assembly 200 rotates forward, the ice may be separated from the lower tray 250 in the state in which the ice is closely attached to the upper tray 150.

In this state, while the lower assembly 200 rotates, the upper ejecting pin 320 passing through the upper opening 154 may press the ice closely attached to the upper tray 150 to separate the ice from the upper tray 150. The ice separated from the upper tray 150 may be supported again by the lower tray 250.

When the ice rotates together with the lower assembly 200 in the state in which the ice is supported by the lower tray 250, even though external force is not applied to the lower tray 250, the ice may be separated from the lower tray 250 by the self-weight thereof.

While the lower assembly 200 rotates, even though the ice is not separated from the lower tray 250 by the self-weight thereof, when the lower tray 250 is pressed by the lower ejector 400, as in FIG. 25, the ice may be separated from the lower tray 250.

Particularly, while the lower assembly 200 rotates, the lower tray 250 may contact the lower ejecting pin 420.

When the lower assembly 200 continuously rotates forward, the lower ejecting pin 420 may press the lower tray 250 to deform the lower tray 250, and the pressing force of the lower ejecting pin 420 may be transmitted to the ice to separate the ice from the lower tray 250. The ice separated from the surface of the lower tray 250 may drop downward and be stored in the ice bin 102.

After the ice is separated from the lower tray 250, the lower assembly 200 may be rotated in the reverse direction by the drive unit 180.

When the lower ejecting pin 420 is spaced apart from the lower tray 250 in a process in which the lower assembly 200 is rotated in the reverse direction, the deformed lower tray 250 may be restored to its original form. That is, the deformed convex portion 251*b* may be returned to its original form.

In the reverse rotation process of the lower assembly 200, the rotational force is transmitted to the upper ejector 300 by the connecting unit 350, such that the upper ejector 300 is raised, and thus, the upper ejecting pin 320 is removed from the upper chamber 152.

When the lower assembly 200 reaches the water supply position, the drive unit 180 is stopped, and then water supply starts again.

According to this embodiment, since the temperature sensor 500 is in contact with the upper tray 150 of which the position is fixed, disconnection due to twisting of the wire connected to the temperature sensor 500 may be prevented. That is, while the lower assembly 200 is rotated, the temperature sensor 500 maintains a fixed state, disconnection due to twisting of the wire of the temperature sensor may be prevented.

What is claimed is:

1. An ice maker comprising:

a first tray assembly comprising (i) a first tray that defines a plurality of first chambers and (ii) a case comprising a plate configured to fix the first tray, the plurality of first chambers being arranged along a first direction and defining first parts of a plurality of ice chambers;

a second tray assembly comprising a second tray that defines a plurality of second chambers, the plurality of second chambers defining second parts of the plurality of ice chambers;

a heater configured to provide heat to the first tray; and a temperature sensor configured to detect a temperature of a water or a temperature of ice in the first tray, wherein the case comprises a first portion that is provided at the plate and coupled to the heater, the plate defining a recess, wherein a portion of the temperature sensor overlaps with the heater, wherein the case further has a second portion for installing the temperature sensor, the second portion of the case comprising a first installation rib and a second installation rib that receive the temperature sensor, and wherein the case defines a heater through-hole which the heater passes through.

2. The ice maker according to claim 1, wherein the heater includes (i) a first portion passing through the heater through-hole and (ii) a second portion coupled to the first portion of the case.

3. The ice maker according to claim 2, wherein the case further comprises a first pressing rib and a second pressing rib that are disposed between the first installation rib and the second installation rib and press the temperature sensor.

4. The ice maker according to claim 1, wherein the case further comprises at least one bridge that extends in a second direction and covers a side of the temperature sensor.

5. An ice maker comprising:

a tray configured to define an ice chamber;

a case comprising a plate configured to fix the tray;

a heater configured to provide heat to the tray; and a temperature sensor configured to detect a temperature of a water or a temperature of ice in the tray, wherein the case comprises a first portion that is provided at the plate and coupled to the heater, the plate defining a recess, wherein a portion of the temperature sensor overlaps with the heater, wherein the case further has a second portion for installing the temperature sensor, the second portion of the case comprising a first installation rib and a second installation rib that receive the temperature sensor, and wherein the case defines a heater through-hole which the heater passes through.

6. The ice maker according to claim 5, wherein the heater includes (i) a first portion passing through the heater through-hole and (ii) a second portion coupled to the first portion of the case, and wherein the heater through-hole is defined at a position corresponding to the second portion of the case.

7. The ice maker according to claim 5, wherein the heater comprises a power input terminal and a power output terminal, and wherein at least one of the power input terminal or the power output terminal passes through the heater through-hole.

8. The ice maker according to claim 5, wherein the heater includes (i) a first portion passing through the heater through-hole and (ii) a second portion coupled to the first portion of the case, and wherein the heater through-hole is defined at a position overlapping with the second portion of the case.

9. An ice maker comprising:

a tray configured to define an ice chamber;

a case comprising a plate for fixing the tray;

a first heater configured to provide heat to the tray; and a temperature sensor configured to detect a temperature of a water or a temperature of ice in the tray, wherein the case comprises a first portion that is provided at the plate and coupled to the first heater, the plate defining a recess, wherein the first heater at least partially surrounds the tray and defines an inner area, wherein a portion of the temperature sensor overlaps with the inner area in a first direction facing the inner area, wherein the case further has a second portion for installing the temperature sensor, the second portion of the case comprising a first installation rib and a second installation rib that receive the temperature sensor, and wherein the case defines a heather through-hole which the heater passes through.

10. The ice maker according to claim 9, wherein the portion of the temperature sensor is spaced apart from the first heater in the first direction.

11. The ice maker according to claim 9, wherein a portion of the case and a portion of the tray are arranged in the first direction.

12. The ice maker according to claim 9, wherein the tray comprises:

a first tray that defines a first chamber, the first chamber defining a first part of the ice chamber; and a second tray that defines a second chamber, the second chamber defining a second part of the ice chamber, and wherein the first chamber and the second chamber are arranged in the first direction.

13. The ice maker according to claim 9, wherein the tray is made of a flexible material, the tray comprising a tray body including a plurality of chamber walls defining a plurality of ice chambers that are (i) arranged along a center line extending through centers of the plurality of ice chambers and (ii) configured to receive water, wherein the first heater is disposed around the plurality of chamber walls and configured to supply heat to separate ice from an inner surface of the plurality of chamber walls, the first heater at least partially surrounding an outer circumference of the plurality of chamber walls and defining the inner area, wherein the temperature sensor is disposed between two adjacent chamber walls among the plurality of chamber walls and configured to sense a temperature of at least a portion of the plurality of ice chambers, and wherein the temperature sensor is provided at the inner area and surrounded by first the heater.

14. The ice maker according to claim 13, further comprising:

a sensor contact portion that is disposed between the two adjacent chamber walls and configured to contact the temperature sensor; and a first heater heating portion that is disposed at the outer circumference of the plurality of chamber walls and configured to be heated by the first heater, wherein the first heater heating portion is spaced apart from the sensor contact portion, and wherein a first distance from the center line to the first heater heating portion in a second direction orthogonal to the first direction is greater than a second distance from the center line to the sensor contact portion in the second direction.

15. The ice maker according to claim 14, further comprising:

a second heater disposed at the outer circumference of the plurality of chamber walls, and a second heater heating portion disposed at the outer circumference of the plurality of chamber walls and configured to be heated by the second heater, wherein the second heater is configured to supply heat to the plurality of ice chambers during an ice-making process.

16. The ice maker according to claim 15, wherein the second heater heating portion is positioned at a lower half of an ice-making volume defined within at least one of the plurality of ice chambers.

17. The ice maker according to claim 16, wherein a distance from the center line to the second heater in the second direction is greater than the second distance from the center line to the sensor contact portion in the second direction.

18. The ice maker according to claim 17, wherein a distance from the sensor contact portion to the first heater heating portion in the second direction is different from a distance from the sensor contact portion to the second heater heating portion in the second direction.

* * * * *